US005391450A

United States Patent [19]

Nagatsuka et al.

[11] Patent Number: 5,391,450

[45] Date of Patent: Feb. 21, 1995

[54] TONER IMAGE HEAT-FIXING METHOD

[75] Inventors: Takayuki Nagatsuka, Yokohama; Tatsuya Nakamura, Tokyo; Hiromi Mori, Yokohama; Takaaki Kohtaki, Yokohama, all of Japan

[73] Assignee: Canon Kabushiki Kaisha, Tokyo, Japan

[21] Appl. No.: 232,340

[22] Filed: Apr. 22, 1994

Related U.S. Application Data

[63] Continuation of Ser. No. 737,038, Jul. 29, 1991, abandoned.

[30] Foreign Application Priority Data

Jul. 31, 1990 [JP] Japan ..... 2-201158
Jul. 18, 1991 [JP] Japan ..... 3-178222

[51] Int. Cl.[6] ..... G03G 13/20

[52] U.S. Cl. ..... 430/99; 430/110; 430/111; 430/124

[58] Field of Search ..... 430/99, 124

[56] References Cited

U.S. PATENT DOCUMENTS

| | | | |
|---|---|---|---|
| 2,297,691 | 10/1942 | Carlson | 430/31 |
| 3,578,797 | 5/1971 | Hodges et al. | 219/388 |
| 4,375,505 | 3/1983 | Newkirk | 430/99 |
| 4,581,312 | 4/1986 | Nakahara et al. | 430/109 |
| 4,626,490 | 12/1986 | Yamazaki et al. | 430/109 |
| 5,071,918 | 12/1991 | Funato et al. | 430/99 |
| 5,143,812 | 9/1992 | Mori et al. | 430/124 |

FOREIGN PATENT DOCUMENTS

| | | |
|---|---|---|
| 0084693 | 8/1983 | European Pat. Off. . |
| 51-29825 | 8/1976 | Japan . |
| 52-3304 | 1/1977 | Japan . |
| 57-52574 | 11/1982 | Japan . |
| 59-18953 | 1/1984 | Japan . |
| 63-276078 | 11/1988 | Japan . |
| 1219764 | 9/1989 | Japan . |
| 1219769 | 9/1989 | Japan . |

*Primary Examiner*—Roland Martin

*Attorney, Agent, or Firm*—Fitzpatrick, Cella, Harper & Scinto

[57] ABSTRACT

A novel method for heat-pressure fixing color toner images in which:

(1) a toner produced by suspension polymerization and containing a wax of a certain molecular weight and a certain melting point in a certain amount, wherein the wax is enclosed in each particle by a vinyl resin, and THF soluble matters having specific molecular weight distribution and is used in conjunction with (2) a fixing means comprising a fixing roller and a pressure roller in mutual pressure contact, through which the transfer medium comes out in the direction inclined toward the pressure roller, and wherein the surface of the fixing roller comprises a fluorine-containing material.

50 Claims, 7 Drawing Sheets

TONER IMAGE HEAT-FIXING METHOD

This application is a continuation of application Ser. No. 07/737,038, filed Jul. 29, 1991, now abandoned.

BACKGROUND OF THE INVENTION

1. Field of the invention

The present invention relates to a method for the heat-pressure fixing of a toner image to a transfer medium such as plain paper or an overhead projector (OHP) film.

2. Related Background Art

A number of methods are hitherto known as electrophotography as disclosed in U.S. Pat. No. 2,297,691, etc. In general, copies are obtained by forming an electrostatic latent image on a photosensitive member by various means utilizing a photoconductive material, developing the latent image by the use of a toner, and transferring the toner image to a transfer medium such as paper if necessary, followed by fixation with heat, pressure, heat-and-pressure, or solvent vapor. Methods for development using toners or methods of fixing toner images have been hitherto proposed in variety, and methods suited for any respective image-forming processes have been employed.

In recent years, with regard to the electrophotography there is a demand for higher-speed copying and higher image quality.

As methods of producing toners, it is commonly known to use a process comprising melt-kneading a thermoplastic resin, a coloring agent such as a dye or a pigment and additives such as a charge control agent to effect their uniform dispersion, thereafter cooling the melt-kneaded product, pulverizing the cooled product by means of a pulverizer, and classifying the pulverized product by means of a classifier to have the desired particle diameter.

In the toners produced through the step of such pulverization, there are limitations in adding a material with release properties (hereinafter "release material") such as wax. For example, to obtain sufficient dispersibility of the release material, there are limitations such that i) the material is not liquefied at the kneading temperature at which it is kneaded together with the resin, and ii) the release material must be contained in an amount of not more than about 5% by weight. Because of such limitations, there is a difficulty in improving the fixing performance of the toners produced by pulverization.

When the toner with a release material is produced by pulverization, the release material is present not only in the interiors of toner particles but also on the surfaces of the toner particles. When the toner produced by pulverization is applied in a heat-fixing method, an appropriate amount of low-molecular weight material with low melt viscosity must be added to the toner so that a sufficient releasability can be provided between a fixing roller of a fixing device and the image to be fixed. In the toner produced by pulverization, however, the low-molecular weight material is also present on the surfaces of toner particles. This brings about a problem of blocking of the toner. It is difficult for the toner produced by pulverization to satisfy both the release properties and anti-blocking properties. On the other hand, when a high-molecular weight component free from the problem of blocking is added, it is necessary to add the high-molecular weight component in a large quantity to the toner in order to impart satisfactory anti-offset properties to the toner. In this instance, however, a material with a high melting point or material with a high softening point is added to the toner in a large quantity, and hence the energy used for fixing the toner must be increased (in other words, the fixing must be carried out at a higher temperature and also at a lower speed). In the case of color toners, this may result in a lowering of the transparency of color toner images fixed on transparent transfer media such as OHP films. Moreover, as for color toners suited for the heat-fixing method, a low-molecular weight material highly capable of imparting releasability must be contained to improve the anti-offset properties, and at the same time, satisfying the anti-blocking properties and the transparency after fixing.

Fixing devices used in the heat-fixing method have hitherto employed a system in which an image is fixed while a transfer medium having an unfixed toner image on its surface is held between, and transported through, a fixing roller, kept at a given temperature, and a pressure roller having an elastic layer and brought into pressure contact with the fixing roller.

In the fixing devices of this type, the unfixed toner on the transfer medium may adhere to the surface of the fixing roller that heats the toner and fuses it to the transfer medium, and this adhered toner is often transferred to the next transfer medium (i.e., an offset phenomenon). In particular, in a full-color toner image-forming apparatus, toners are fixed at a relatively high temperature so that plural kinds of color toners may be color-mixed in their nearly molten state. Hence the offset phenomenon occurs with greater frequency in full-color toner image fixation than in single-color toner fixation wherein the toner is merely softened and fixed under application of pressure.

As a means for preventing the offset phenomenon, it is common to incorporate a cross-linked resin component into a toner. This method can be effective for imparting anti-offset properties, but may cause the lowering of heat fusion characteristics of the toner. In order to reproduce a half tone in the multi- or full-color fixation process the plural kinds of color toners must be mixedly present on a transfer medium, must be melted in a good state, and it is preferable that the cross-linked resin component not be contained in the toner. For this reason, in a method of fixing color toners using a heat roller, it is common to prevent high-temperature offset by coating the heat roller with a release material such as silicone oil.

From another aspect, it is known to improve the offsetting to a fixing roller by adding to a toner a release material such as polyethylene wax or polypropylene wax (Japanese Patent Publications No. 52-3304 and No. 57-52574). When the polyethylene wax or polypropylene wax has been added to a color toner in an amount necessary for imparting thereto a satisfactory releasability against the fixing roller, it is difficult to achieve a satisfactory transparency for the color toner image fixed onto a transparent transfer medium.

As another method for solving the problem of the offset, U.S. Pat. No. 3,578,797 proposes a method in which a toner image is heated to its melting point by a heating element, the toner image thereby melted is thereafter cooled into a relatively viscous state, where a transfer medium (a toner bearing medium) having the toner image is separated from a heating web in the state that the toner has a weakened adhesion, so that the toner image can be fixed without causing the offset. U.S. Pat. No. 3,578,797 also discloses a system in which the toner image is heated without bringing the toner image and transfer medium into pressure contact with the heating element, so that the transfer medium is not positively heated and hence, the toner can be melted using a smaller amount of energy than in other methods. When, however, the toner image and transfer medium come into contact with the heating element without the pressure contact, the efficiency of thermal conduction is lowered and it takes a relatively long time for the heating and melting of the toner to occur. In particular, in the case of the full-color toner image, it becomes necessary for the individual color toners to be color-mixed with each other in their nearly molten state. Accordingly, the method disclosed in U.S. Pat. No. 3,578,797 must be further improved when full-color toner images are desired.

Japanese Patent Publication No. 51-29825 proposes that a pressure contact means is added to the fixing method of U.S. Pat. No. 3,578,797 so that the efficiency of thermal conduction can be improved and the toner can be heated and melted in a short time and yet in a satisfactory state. This method makes it possible to sufficiently heat and melt the toner because of the pressure contact employed, and is particularly preferable in the color mixing in the formation of color toner images. Since, however, the pressure is applied at the time the toner is heated and melted, the adhesion between the heating element and the toner may become so strong that separation of the toner image transfer medium from the heating element becomes problematic even after the toner cools. In the Japanese Patent Publication No. 51-29825, Teflon (a trade name of fluorine resins such as polytetrafluoroethylene) with a low surface energy is used on the surface of the heating element so that adhesion between the toner and the heating element can be decreased and the separation of the toner image transfer medium from the heating element can be improved.

In order to improve the fixing of color toners and also prevent the offset phenomenon by the use of the fixing device or fixing method as disclosed in U.S. Pat. No. 3,578,797 or Japanese Patent Publication No. 51 -29825, one may contemplate use of a color toner comprising a toner containing a material having release properties. However, as previously stated it is difficult to obtain satisfactory transparency in the color toner image fixed on the transparent transfer medium, when the polyethylene wax or polypropylene wax has been added to the color toner in an amount necessary for imparting thereto a satisfactory releasability against the heating element. Thus, it is sought to provide a toner suited for a heat-fixing method as well as having excellent release properties.

SUMMARY OF THE INVENTION

An object of the present invention is to provide a heat-pressure fixing method that has eliminated the above problems.

Another object of the present invention is to provide a heat-pressure fixing method that can achieve a superior low-temperature fixing performance.

Still another object of the present invention is to provide a heat-pressure fixing method that can achieve superior anti-offset properties in high-temperature running.

A further object of the present invention is to provide a heat-pressure fixing method that may cause less winding of a transfer medium around a fixing roller.

A still further object of the present invention is to provide a heat-pressure fixing method that can achieve a superior running performance on a large number of copy sheets.

A still further object of the present invention is to provide a heat-pressure fixing method that can form a fixed image having a superior gloss.

The objects of the present invention can be achieved by a heat-pressure fixing method comprising the following steps.

A first step of transferring to a transfer medium a negatively charged toner image formed on an electrostatic-image bearing member, wherein the toner of said toner image containing a wax and a vinyl resin with the wax having a weight average molecular weight (Mw) of from 500 to 1,500 and a melting point of from 55° C. to 100° C., in an amount of from 10 parts by weight to 50 parts by weight based on 100 parts by weight of the vinyl resin and further wherever said wax is enclosed in each toner particle by said vinyl resin, said toner further contains tetrahydrofuran(THF)-soluble matter whose molecular weight distribution, as measured by gel permeation chromatography, has a weight average molecular weight (Mw) of from 10,000 to 500,000, a number average molecular weight (Mn) of from 1,000 to 100,000, Mw/Mn (value-A) of from 4 to 20, while Mw/Mn (value-B) of the THF-soluble matter having a molecular weight of not less than 1,500, is from 2 to 10.

A second step of fixing said toner image on the transfer medium by the use of a fixing means comprising a fixing roller and a pressure roller that are so provided as to be in mutual pressure contact and through which said transfer medium comes out in the direction inclined toward the pressure roller from the line perpendicular to the line connecting the center of the fixing roller and the center of the pressure roller. The pressure applied between the fixing roller and the pressure roller is not less than 2 kg/cm$^2$ and the surface of said fixing roller is made of a material comprising a fluorine-containing material.

DESCRIPTION OF THE PREFERRED EMBODIMENTS

In the present invention, the device used as a a fixing device is a heat-roller fixing device provided with a fixing roller and a pressure roller, wherein i) the surface of said fixing roller is made of a material comprising a fluorine-containing material, ii) when a blank sheet of paper is passed through the rollers, the sheet comes out in the direction inclined toward the pressure roller from the line perpendicular to the line connecting the center of the fixing roller and the center of the pressure roller, and also iii) the pressure applied between the fixing roller and the pressure roller is not less than 2 kg/cm$^2$.

Herein, "pressure roller side" means to the side on which no toner image is borne of a transfer medium such as paper or OHP film. That is to say, for example, when a sheet of paper comes out in the direction inclined toward the pressure roller, the toner image heated by the fixing roller can be separated from the fixing roller at a greater angle. The offset phenomenon is concerned with the agglomeration force acting between toner particles, the affinity of the toner particles for the fixing roller and the affinity of the toner particles for the transfer medium. By making greater the angle at which the toner image is separated from the fixing roller, separation and output of the transfer medium from the fixing roller are thus enabled with a weak affinity of the toner particles for the fixing roller. Accordingly the offset phenomenon and the winding of the transfer medium around the fixing roller can be avoided.

As a result, the anti-offset properties in high-temperature running can be remarkably improved.

In the present invention, the pressure applied between the fixing roller and the pressure roller is controlled to be not less than 2 kg/cm$^2$, and preferably not less than 3 kg/cm$^2$.

A fixing pressure less than 2 kg/cm$^2$ may result in poor anti-offset properties. Some reasons therefor can be presumed. One reason is that when a low pressure is applied the wax enclosed in each toner particle cannot easily exude therefrom to the interface between the toner particle and the fixing roller. The other reason is that such a low pressure results in an insufficient deformation of toner particles to provide a weak agglomeration force between toner particles.

Thus, setting the fixing pressure to such a high degree can bring about a desirable improvement in high-temperature off-set phenomenon. Setting the fixing pressure to such a high degree can also bring about an improvement in the surface smoothness of a fixed image obtained, thus giving a high image quality. In particular, when a toner image is fixed to a sheet for an overhead projector (OHP), its transparency can be improved to give preferable results.

Figure 2:
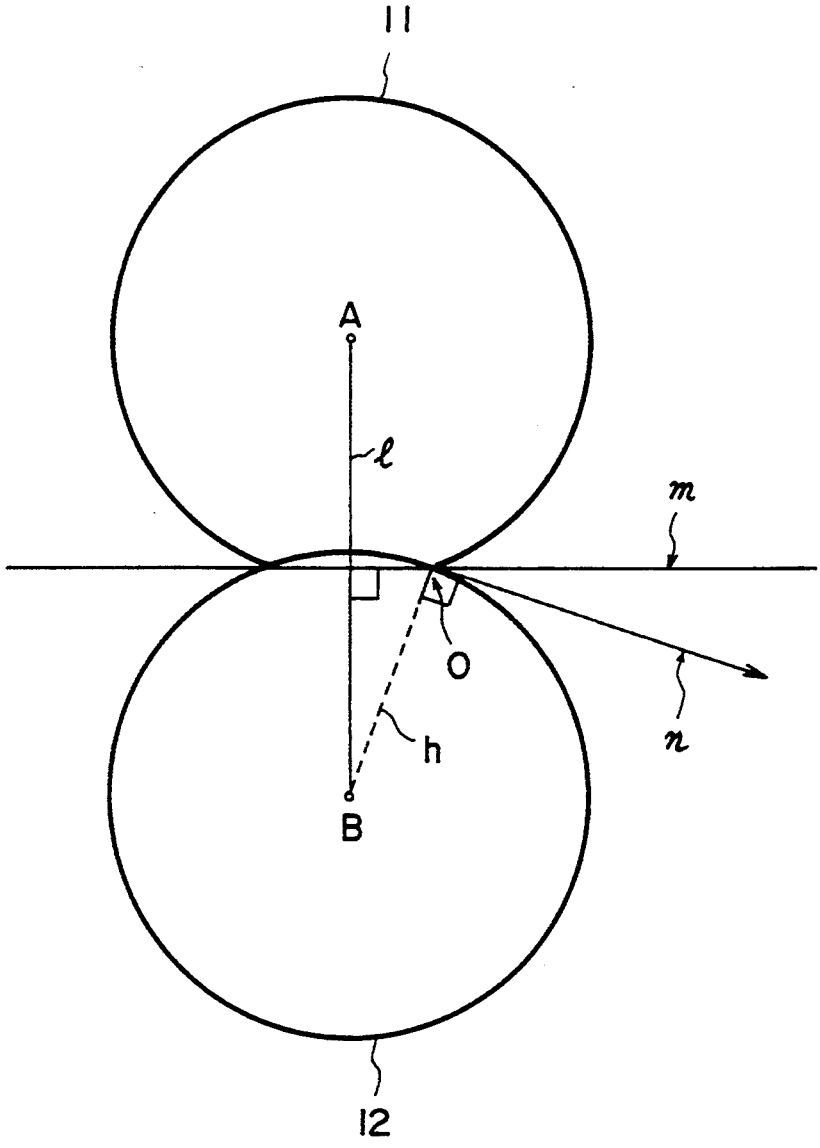
FIG. 2 is a view relating to a fixing device in which paper comes out in the direction inclined toward the pressure roller side.

The direction of paper output at the time a blank sheet of paper is passed through a fixing device will be specifically described below. As shown in FIG. 2, with respect to a line l that connects the center-A of a fixing roller 11 and the center-B of a pressure roller 12, perpendicular line m is drawn through the rear end of the nip between the rollers (i.e., the point o at which the both rollers come apart). This perpendicular line m is regarded as the standard line of the paper output direction. When a blank sheet of paper (transfer medium) is passed through the rollers and the top of the transfer medium having passed the point o is inclined toward the pressure roller with respect to the standard line m, the paper output direction(line n) is defined to be on the pressure roller side.

The blank sheet of paper used here has a weight of 60 g/m$^2$ to 85 g/m$^2$, and is passed through the rollers in such a state that the direction of paper texture and the directions of roller shafts are parallel. The surface temperature of the fixing roller is controlled to be 150° C. to 200° C. The paper is passed at a speed of 85 mm/sec to 140 mm/sec. The paper output direction is judged using a high-speed camera.

The paper output direction can be controlled to be on the pressure roller side, for example, in the following way:

(1) The pressure roller is made to have a hardness higher than the hardness of the fixing roller.

The pressure roller can be made to have such a higher hardness by a method including a) a method in which an elastic material is made to have a higher hardness and b) a method in which an elastic material layer is made thin.

(2) The fixing roller is made to have a larger diameter than the diameter of the pressure roller.

A heating device may be provided not only to the fixing roller but also to the pressure roller, so that the winding-jam of paper can be significantly reduced.

The fixing device in which such a method is employed may include a roller comprising as the fixing roller an elastic material comprised of a silicone rubber, which is of an RTV-type or LTV-type, and whose surface is made of a fluorine-containing material, preferably a fluorine resin.

The fixing roller used may have a double-layered structure comprising a combination of a silicone rubber and a fluorine rubber or a combination of a silicone rubber or fluorine rubber and a Teflon-coated material. Alternatively, the fixing roller may have a triple-layered structure comprising a combination of a silicone rubber or fluorine rubber, a Teflon-coated material and a fluorine rubber.

Preferably, the fixing roller is a roller comprising a mandrel and having provided thereon a coat-layer having a double-layered structure. The double-layered structure comprises a lower layer comprising an elastic HTV silicone rubber and an upper layer comprising a PFA resin, or a roller having a coat-layer of an HTV silicone rubber layer as the lower layer and a fluorine resin-dispersed fluorine rubber layer as the upper layer, on which the fluorine resin is locally deposited by heat treatment. The fluorine resin layer thus formed may preferably have a thickness of 5 μm to 100 μm, and preferably 10 μm to 60 μm.

The surface of the fixing roller should have a hardness (in the case of two layers, a hardness in total of the two layers) of 30° to 70°, and preferably 35° to 60°, as a rubber hardness (JIS-A). The layer on the mandrel of the fixing roller should have a thickness of 0.5 mm to 5 mm, preferably 1.0 mm to 3.5 mm, and more preferably 1.0 mm to 3 mm.

The surface material of the pressure roller may preferably have a higher hardness than the surface layer of the fixing roller. Its surface may have a hardness of not less than 40°, and preferably not less than 50°. As a material therefor, a silicone rubber material, a fluorine rubber material and a Teflon-coated material can be used. The diameter of each roller cannot be made excessively large because of the demand for compact size copying machines. On the other hand, an excessively small roller diameter can not provide enough nip area between rollers to allow the toner to sufficiently melt, resulting in a poor color mixing performance or slower fixing speed in order to achieve a good color mixing performance. Hence, it is suitable for the fixing roller and the pressure roller to each be 30 mm to 90 mm in diameter, and preferably 40 mm to 80 mm in diameter.

Figure 1:
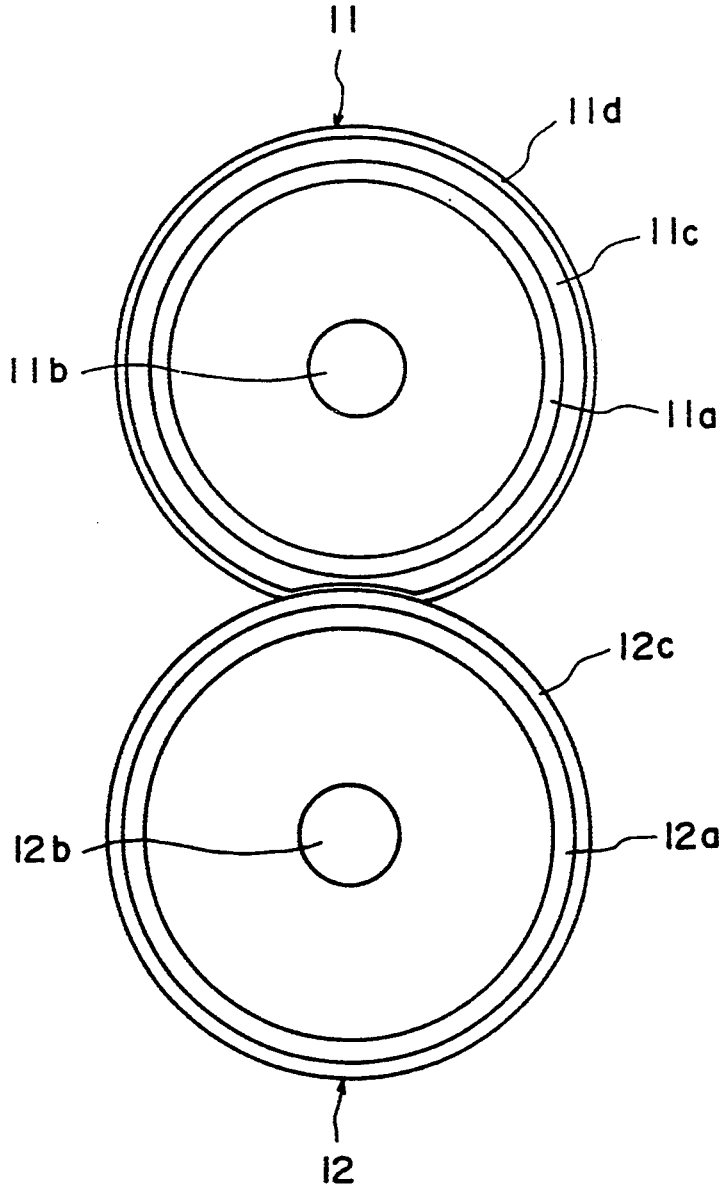
FIG. 1 is a schematic illustration of an example of the fixing device used in the present invention.

FIG. 1 schematically illustrates an example of a preferred fixing device. In FIG. 1, a fixing roller 11 comprises a mandrel 11*a* provided in its interior with a heater 11*b*, an HTV silicone rubber layer 11*c* provided on the mandrel, and a tetrafluroethylene-perfluoroalkyl vinyl ether copolymer (PFA resin) layer 11*d* further provided thereon. The pressure roller 12 comprises a mandrel 12*a* provided in its interior with a heater 12*b*, and a fluorine rubber layer 12*c* provided on the mandrel. In the fixing device as shown in FIG. 1, the paper output direction is on the pressure roller side as shown in FIG. 2. Moreover, in the present invention, a negatively chargeable toner is used as the toner. Hence the toner image has a negative triboelectricity and is electrostatically repulsed by the surface of the fixing roller comprising a fluorine-containing material. For this reason, the fixing method of the present invention can bring about a further improvement in the anti-offset properties and winding jam prevention.

Figure 3:
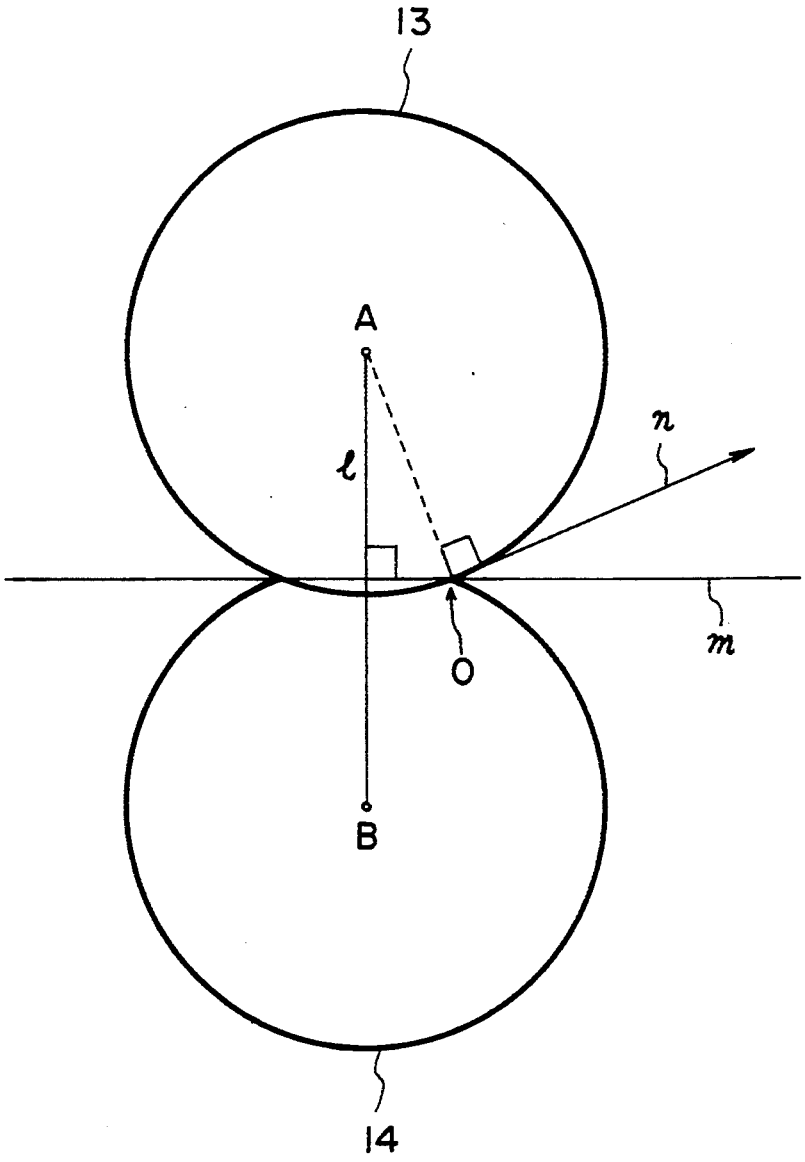
FIG. 3 is a view relating to a fixing device in which paper comes out in the direction inclined toward the fixing roller side.

On the other hand, at the nip portion formed by the roller constitution as shown in FIG. 3, the paper output direction tends to be upward. That is, the transfer medium having passed the nip portion comes out toward a fixing roller 13.

When the paper comes out in this way, the toner is not only heated when the transfer medium passes the nip portion, but also when said toner is exposed to radiation heat from the fixing roller 13 even after the transfer medium has come out of the nip portion. In some instances, the paper emerges from the nip attached to the fixing roller until the paper contacts a separation claw, resulting in the toner being excessively melted by excess heat. As a result, a fixed image may have an extremely high gloss, and also the offset phenomenon tends to occur.

Such phenomena cannot easily occur in black and white copying because of use of a toner with a high melting point. In addition, the fixed image with a high gloss does not become a problem because most of original black and white images are in themselves composed of character information or line images. In the case of multi-color images, however, toners with a low melting point are often used and originals may often have a large image area. Accordingly, the above problems tends to occur.

The fixing method of the present invention can be greatly effective when multi-color toner images are fixed.

In the toner of the present invention, the wax with a weight average molecular weight (Mw) of from 500 to 1,500 may referably comprise a non-polar material and also have release properties. For example, it may preferably be paraffin wax.

The paraffin wax is enclosed inside of each toner particle. The toner in which the paraffin wax is enclosed can be preferably prepared by suspension polymerization as described later. The paraffin wax is liquefied at an environmental temperature when it has a lower melting point than the environmental temperature, and hence it may exude from the interior to the surface layer even when enclosed within toner particles and cause blocking in some instances. For this reason, the paraffin wax should have a melting point of 55° C. to 100° C., preferably from 60° C. to 100° C., and more preferably 65° C. to 80° C. The paraffin wax should be contained in an amount of 10 parts by weight to 50 parts by weight, and preferably 15 parts by weight to 45 parts by weight, based on 100 parts by weight of a vinyl resin. If the wax is present in an amount less than 5 parts by weight, this may bring about a difficulty in imparting satisfactory release properties to the toner. If present in an amount more than 50 parts by weight, this situation makes it difficult for the paraffin wax to be well enclosed in toner particles, tending to cause blocking of the toner.

The melting point of the paraffin wax can be measured by the following method.

The melting point of paraffin wax is measured by differential scanning analysis using a differential scanning calorimeter (DSC).

For example, a differential scanning calorimeter DSC-7, manufactured by Perkin Elmer Co., is used in the measurement.

A measuring sample is precisely weighed in an amount of 5 to 20 mg, and preferably 10

The sample is put in an aluminum pan, and, using an empty aluminum pan as a reference, the measurement is carried out in an environment of normal temperature and normal humidity, setting the measuring temperature within the range of 30° C. to 200° C. and raising the temperature at a rate of 10° C./min.

During the raising of the temperature, the temperature at which an endothermic peak corresponding to the main peak within the range of temperatures 30° C. to 160° C. is determined as the melting point of the paraffin wax in the present invention.

In the present invention, it is preferred to select materials for the toner so that the contact angle between the surface of a pellet prepared by molding a toner and the surface of water comes to be 80° to 110°. The surface of the fixing roller of the fixing device is made of a material comprising a fluorine-containing material.

The fluorine-containing material for the surface of the fixing roller is a material with a small surface energy and superior release properties. In order to make such a feature of the roller more effective, it is preferred to use the material that may give a contact angle with water of 80° to 110° to the surface of a pellet prepared by molding a toner.

Use of such a material makes it possible to weaken the attraction force between the toner particles and the fixing roller, bringing about an improvement in the offset prevention.

Even if the contact angle of the toner pellet surface and the water surface is 80° to 110°, the merit of the toner cannot be fully obtained unless the surface of the fixing roller is comprised of the fluorine-containing material. For example, a fixing roller having a silicone rubber surface layer coated with a silicone oil can be a roller having a superior anti-offset properties, but cannot necessarily bring about good results even when used in combination with the toner of the present invention, as compared with the fluorine type fixing roller. Moreover, the silicone rubber roller requires a higher running cost because of the consumption of silicone oil in large quantities.

The contact angle in the present invention can be measured in the following way.

The toner is formed into pellets using a tablet machine. Here, the molding surface should be mirror-finished and a sufficient pressure should be applied so that smooth surfaces can be obtained. The contact angle of the surface of the resulting pellet and the water surface is measured using a contact angle meter (a CA-DS type, manufactured by Kyowa Kagaku K.K.).

The toner used in the present invention is obtained, for example, by the method as described below. A wax (e.g., paraffin wax), a coloring agent, a polymerization initiator and other additives are added to polymerizable monomers, and these are uniformly dissolved or dispersed using a dispersion machine, such as an ultrasonic dispersion machine or a homogenizer, to give a monomer composition. This monomer composition is dispersed in an aqueous phase (i.e., a continuous phase) containing a suspension stabilizer using a usual stirring machine or a high-shear stirring machine such as a homomixer or a homogenizer. The stirring speed and stirring time may preferably be controlled so that the droplets of the monomer composition have a size of the desired toner particles (usually a size of not more than 30 μm), and thereafter, the stirring may be carried out to the extent that the settling of particles is prevented and the state of dispersion can be maintained by the action of the dispersion stabilizer. The polymerization may be carried out using a polymerization temperature of 40° C. or above, and usually a temperature of 50° C. to 90° C. In view of the need to control of the molecular weight distribution of the resin component, it is preferable to change the polymerization temperature during polymerization. After the reaction has been completed, the toner particles thus produced are washed and then collected by filtration, followed by drying. In the suspension polymerization, water may preferably be used as a dispersion medium usually in an amount of 200 parts by weight to 3,000 parts by weight based on 100 parts by weight of monomers.

In the suspension polymerization, a wax having substantially no hydroxyl group, carboxyl group or ester group can be readily enclosed in the interior of each particle.

The polymerizable monomers that can be applied in the production of the toner used in the present invention may include vinyl monomers. They can be exemplified by styrene, styrene derivatives such as o-methylstyrene, m-methylstyrene, p-methylstyrene, p-methoxystyrene and p-ethylstyrene, methacrylic esters such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate, acrylic esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate and phenyl acrylate, and acrylic acid or methacrylic acid derivatives such as acrylonitrile, methacrylonitrile and acylamide.

These monomers can be used alone or in the form of a mixture. Of the above monomers, it is preferred in view of the developing performance and durability of the toner to use styrene or a styrene derivative alone, or a combination of styrene and another monomer as polymerizable monomers.

The polymerization initiator used for polymerizing the monomers may include azo or diazo type polymerization initiators such as 2,2'-azobis-(2,4-dimethylvaleronitrile), 2,2'-azobisisobutyronitrile, 1,1'-azobis(-cyclohexane-1-carbonitrile), 2,2'-azobis-4-methoxy-2,4-dimethylvaleronitrile and other azobisisobutyrionitrile (AIBN); and peroxide-type polymerization initiators such as benzoyl peroxide, methyl ethyl ketone peroxide, isopropyl peroxycarbonate, cumene hydroperoxide, 2,4-dichlorylbenzoylperoxide, and lauroyl peroxide. These polymerization initiators may preferably be used usually in an amount of about 0.5% by weight to about 5% by weight of the weight of the polymerizable monomers.

In order to prepare the toner of the present invention by the suspension polymerization, it is preferred, in view of the need to control the molecular weight characteristics of the resin component to use the polymerization initiator in a combination of two or more kinds. It is more preferable to use a combination of two polymerization initiators whose half-life at the reaction temperature of the initial stage of the polymerization are 100 minutes to 500 minutes and 1,000 minutes to 5,000 minutes, respectively.

In the polymerization of monomers, it is preferred to polymerize the monomers with addition of a polar material such as a polymer having a polar group or a copolymer having a polar group.

In the present invention, the material used as the polar material contained in the monomer is a material having a polar group in the molecule and capable of causing a decrease in surface tension at the interface between water and the polymerizable monomer composition.

The above polar material used in the present invention may preferably be a slightly water-soluble material from the viewpoint of improving environment characteristics of the toner particles.

Herein, the "slightly water-soluble material" refers to a material with a solubility of not more than 1 g, and preferably a solubility of not more than 500 mg, and particularly preferably not more than 100 mg, in 100 ml of water.

In the present invention, a low-molecular compound or a polymeric compound can be used as the above polar material. The latter polymeric compound is preferred. In the case of the polymeric compound, a compound having a weight average molecular weight of from 5,000 to 500,00 as measured by GPC (gel permeation chromatography) may preferably be used in view of the advantages that it can readily dissolve or disperse in the polymerizable monomers and can also impart the durability to the toner.

Stated more specifically, anionic compounds as shown below are preferably used as this polar material.

Anionic compounds:

They are compounds containing an anionic polar group as exemplified by a carboxyl group, a hydroxyl group, a dibasic acid group, a dibasic acid anhydride group, a sulfonic acid group, a sulfonate group or a phosphate group.

They may more specifically include polymers or copolymers of polar vinyl monomers as exemplified by unsaturated carboxylic acids such as acrylic acid or methacrylic acid, unsaturated dibasic acids, anhydrides of unsaturated dibasic acids, and acrylates or, methacrylates having a hydroxyl group; copolymers of any of these polar vinyl monomers and styrene, acrylate or methacrylate; and polyester resins.

When the polar material comprises the anionic polar polymer, it may preferably have an acid value and/or hydroxyl group value of 0.5 to 100, and preferably 1 to 30. It may preferably be added in an amount of 0.5 part by weight to 50 parts by weight, and more preferably 1 part by weight to 40 parts by weight, based on 100 parts by weight of the polymerizable monomers.

In the polar polymer used in the present invention, a polymer with an acid value and/or hydroxyl group value of less than 0.5 can be less effective for decreasing the surface tension. On the other hand, a polymer with an acid value and/or hydroxyl group value of more than 100 is undesirable since it may bring about an excessively strong hydrophilicity.

Herein, the acid value refers to the number of milligrams of potassium hydroxide required for neutralizing carboxyl groups contained in 1 g of a sample.

The hydroxyl group value refers to the number of milligrams of potassium hydroxide required for neutralizing acetic acid combined with hydroxyl groups when 1 g of a sample is acetylated by the prescribed method.

These polar materials should be added in an amount of 0.5 part by weight to 50 parts by weight, and preferably 0.5 part by weight to 50 parts by weight, based on 100 parts by weight of the polymerizable monomers. Addition of these polar materials in an amount less than 0.5 part by weight makes it difficult to obtain a sufficient quasi-capsule structure and therefore making it difficult for the wax to be well enclosed and resulting in a lowering of anti-blocking properties. Addition in an amount more than 50 parts by weight may result in a shortage of the amount of the polymerizable monomers, strongly tending to lower the characteristics required as a toner.

In the present invention, the polymerization may preferably be carried out by suspending the polymerizable monomer composition, in which any of the above polar materials has been added, in an aqueous phase of an aqueous medium in which a slightly water-soluble inorganic dispersant, that is soluble in a Br nsted acid such as hydrochloric acid, has been dissolved. In this instance, the polar material is attracted to the surface layers of the particles that form a toner, and hence gives a form like a shell. Thus, the resulting particles each come to have a quasi-capsule structure. The polar material with a relatively high molecular weight, attracted to the particle surface layers, imparts excellent properties to the toner, as exemplified by anti-blocking properties, developability, charge control properties and wear resistance.

As for the above slightly water-soluble inorganic dispersant that is soluble in a BrØnsted acid, it refers to an inorganic compound slightly soluble in water and also soluble in a BrØnsted acid. Stated more specifically, the water-soluble inorganic dispersant has a solubility of not less than 20 g in 100 ml of water.

Here, the inorganic compound slightly soluble in water refers to a compound having a solubility of not more than 10 mg, and preferably not more than 5 mg, in 100 ml of neutral ion-exchanged water.

Examples of the slightly water-soluble inorganic dispersant usable in the present invention are shown below.

As an inorganic compound that is rendered neutral or alkaline in water, it can be exemplified by calcium phosphate, magnesium phosphate, calcium sulfate, magnesium carbonate, calcium carbonate, and $Ca_3(PO_4)_2 \cdot Ca(OH)_2$.

Such inorganic compounds may preferably have a particle diameter of 2 μm or less, and more preferably 1 μm or less, as a primary particle.

The particle diameter in a dispersion medium of the slightly water-soluble inorganic dispersant described above can be measured using a Coulter counter. For example in a 1% brine, a sample (the inorganic compound) is added so as to be in a concentration of 10%, and is subjected to ultrasonic dispersion according to a conventional method (36 kHz, 100 W, for 1 minute). Thereafter, the particle diameter is measured with a Coulter counter by a conventional method by the use of a 100 μm orifice.

In the number distribution of the inorganic dispersant as measured by such a method, it is preferred that the proportion of particles of 5.04 μm or larger in particle diameter is 5% by number, and it is more preferred that the proportion of particles of 3.17 μm or larger in particle diameter is 5% by number.

As for an inorganic dispersant, a slightly water-soluble inorganic compound such as calcium phosphate can be prepared using sodium phosphate and calcium chloride in water, which may be used directly. This method is preferred in view of the advantage that an inorganic compound that is in the state of fine particles and has a good dispersibility can be readily obtained.

In general, the powder of slightly water-soluble inorganic compound strongly agglomerates and the particle diameters in this agglomerated state are not uniform. Hence, when such a powder is used, its dispersion in water must be carefully carried out in many instances. However, use of the method wherein the slightly water-soluble inorganic compound is formed in water as described above does not require such care and makes it possible to obtain a good dispersed state of the inorganic compound.

In addition, water-soluble neutral salts that are formed together with the slightly soluble compound, when the slightly water-soluble compound is formed in water, have both the effect of preventing the monomers from being dissolved in water and the effect of increasing the specific gravity of the aqueous medium.

In the present invention, the pH of the dispersion medium containing the slightly water-soluble inorganic dispersant as described above is adjusted to preferably 7.1 to 11.0.

If this pH is more than 11.0, the dispersion medium may become so strongly alkaline that the monomer composition tends to have insufficient granulating properties.

On the other hand, if pH of the above dispersion medium is less than 7.1, the surface of the monomer composition may have an insufficient decrease in surface tension.

When the pH is adjusted below 7.1 the pH may preferably be adjusted by adding to the dispersion medium containing the slightly water-soluble inorganic dispersant an alkaline water-soluble inorganic salt to give an aqueous dispersion medium having the capability of promoting the surface activity of the polar material.

The alkaline water-soluble inorganic salt used in such an instance may include $Na_3PO_4$, $Na_2CO_3$, NaOH and KOH.

In such a method, the water-soluble inorganic salt may optionally be used in combination of two or more kinds.

A preferred combination thereof may include a combination of an anionic compound and a slightly water-soluble inorganic dispersant which can be neutral or alkaline in water. In such a combination, it is more preferred to adjust the pH by adding the alkaline water-soluble inorganic salt.

Examples of the reaction that produces the slightly water-soluble inorganic compound are shown below. Examples thereof are by no means limited to these.

(1) $2Na_3PO_4+3CaCl_2=Ca_3(PO_4)_2+6NaCl$ (2) $2Na_3PO_4+3MgSO_4=Mg_3(PO_4)_2+3Na_2SO_4$ (3) $2Na_3PO_4+Al_2(SO_4)_3=2AlPO_4+3Na_{2SO4}$ (4) $Na_2SO_4+CaCl_2=CaSO_4+2NaCl$
(5) $Na_2CO_3+MgSO_4=MgCO_3+Na_2SO_4$
(6) $Na_2CO_3+CaCl_2=CaCO_3+2NaCl$
(7) $2Na_3PO_4+3ZnSO_4=Zn_3(PO_4)_2+3Na_2SO_4$
(8) $Na_2CO_3+ZnCl_2=ZnCO_3+2NaCl$
(9) $Na_2CO_3+ZnSO_4=ZnCO_3+Na_2SO_4$

In the method described above, the slightly water-soluble inorganic dispersant may also optionally be used in combination of two or more kinds.

In the present invention, a medium having substantially no compatibility with the polymerizable monomers is used as the dispersion medium. It is preferred to use an aqueous dispersion medium.

In the present invention, a medium containing substantially no water-soluble surface active agent is used for the dispersion medium containing the slightly water-soluble inorganic dispersant. In the present invention, the water-soluble surface active agent can be used in an amount not more than 0.001 part by weight based on 100 parts by weight of the inorganic dispersion stabilizer previously described. The use of a water-soluble surface active agent, however, is not necessary.

The above method is particularly preferred when the polymerization is carried out at a low temperature, thereby effecting suppressed decomposition of a polymerization initiator and thus increasing the polymer molecular weight. The purpose of said initiator is to control the molecular weight distribution of the polymer, in view of the resultant cohesion attribute to the increasing viscosity during the prolonged polymerization process.

The polymerization temperature in such an instance may preferably be such a temperature that the half-life of the polymerization initiator comes to be 500 minutes or more, and more preferably 1,000 minutes or more.

In the polymerization process as described above, it is also possible to employ a method in which the polymerization temperature is raised after the dispersibility of particles has been stabilized, thereby producing a polymer with a smaller molecular weight so that the ratio of weight average molecular weight to number average molecular weight (Mw/Mn) becomes larger.

In the present invention, the granulation of the monomer composition in the aqueous dispersion medium is carried out, for example, with a homomixer, homogenizer or the like having a high-speed rotary turbine and a stator. Usually, the stirring speed and time may preferably be controlled so that the particle size of the monomer composition becomes 30 μm or less. The number of revolution may preferably be set so that the turbine is rotated at a peripheral speed of 10 m/sec to 30 m/sec. There are no particular limitations on the granulation time, which may preferably be 5 minutes to 60 minutes.

In the step of granulation, the liquid temperature may be controlled to make the viscosity of the monomer composition 1 cps to 1,000,000 cps, and preferably 10 cps to 100,000 cps. This viscosity range thus enables the particle diameter of the monomer composition to be made 1 μm to 10 μm, resulting in a toner for development having a weight average particle diameter of 1 to 10 μm. Since water or an aqueous medium mainly composed of water is usually used as the liquid dispersion medium, the temperature of the dispersion system should preferably be controlled at 20° C. to 80° C., and more preferably 40° C. to 70° C.

In the dispersion system, the liquid dispersion medium may preferably be present in amount of from 200 to 1,000 parts by weight based 100 parts by weight of the monomer composition. The slightly water-soluble inorganic dispersant may preferably be used in an, amount of 1% to 20% by weight, and more preferably 1% to 10% by weight, based on the weight of the polymerizable monomer composition (at the time of granulation or at the initial stage of the polymerization).

In the present invention, the polymerization is carried out using a method in which it is confirmed that the particles of the monomer composition have a given particle size, and then the polymerization is allowed to proceed while controlling the liquid temperature (e.g., 55° C. to 70° C.) of the aqueous medium containing such particles. Alternatively, a method may be employed in which, by controlling the liquid temperature of the dispersion medium, the polymerization is allowed to proceed simultaneously with the granulation and dispersion process.

After the polymerization of the monomer composition has been completed, toner particles can be obtained by a conventional post treatment. For example, a Brønsted acid is added to a system containing the polymer particles thus produced, and the slightly water-soluble inorganic dispersant is removed by a suitable means such as filtration, decantation or centrifugal separation to collect the polymer particles which are then dried to give a toner.

The Brønsted acid-soluble, slightly water-soluble inorganic dispersant used in the present invention can be readily removed from toner particle surfaces by the above acid treatment. In the toner from which the dispersant has been removed, there is substantially no ill influence that makes the toner particle surfaces hydrophilic (which is due to residual dispersant), and thus a good toner development performance can be obtained.

In the above method of producing the toner, it is important to select conditions so that the wax having a weight average molecular weight (Mw) of 500 to 1,500 and a melting point of 55° C. to 100° C. can be well enclosed in the particle. It is also important to select conditions for its production so that the toner produced by suspension polymerization of the polymerizable monomer composition can have such molecular weight distribution of total THF-soluble matter contained therein, that the weight average molecular weight (Mw) is from 10,000 to 500,000, and preferably 15,000 to 200,000, a number average molecular weight (Mn) from 1,000 to 100,000, and preferably 2,000 to 30,000. Mw/Mn (value-A) is from 4 to 20, and preferably 5 to 15, as well as Mw/Mn(value-B) for a THF-soluble matter having a molecular weight of not less than 1,500, is from 2 to 10, and preferably 2.5 to 8. These values are determined by gel permeation chromatography. In view of the offset prevention, the value-A of Mw/Mn may more preferably be larger than the value-B by 2 or more.

Figure 4:
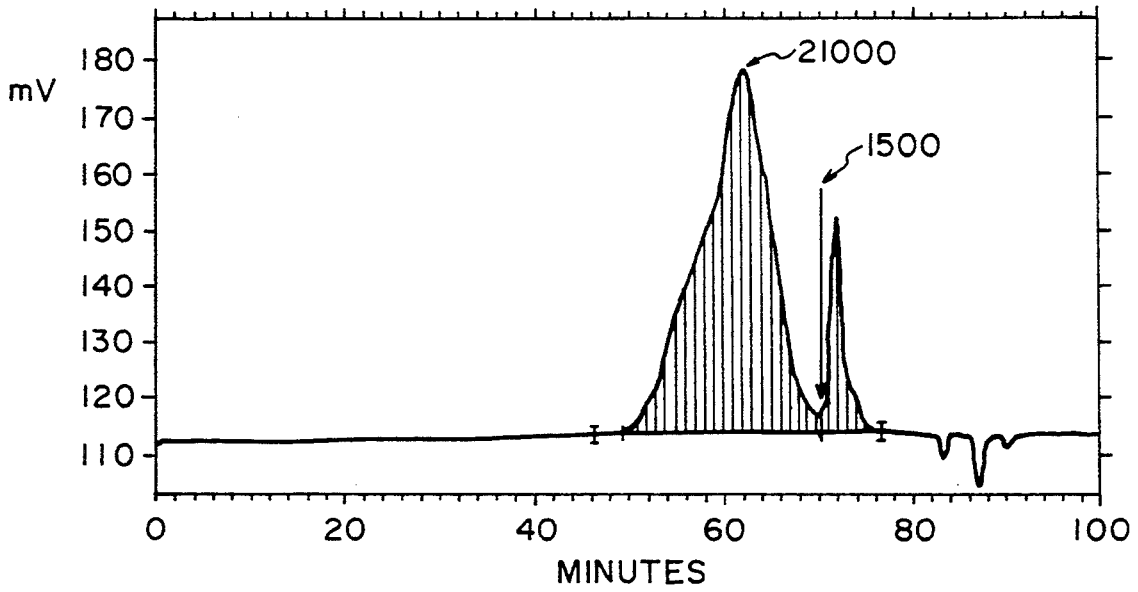
FIGS. 4 and 5 are views relating to GPC chromatograms of toners.

FIG. 4 shows a chromatogram obtained by GPC of the THF-soluble matter of a toner obtained in Example 1 described later. In the chromatogram shown in FIG. 4, the weight average molecular weight (Mw) is 56,000, the number average molecular weight (Mn) is 6,000, and the value-A of Mw/Mn is 9.3.

Figure 5:
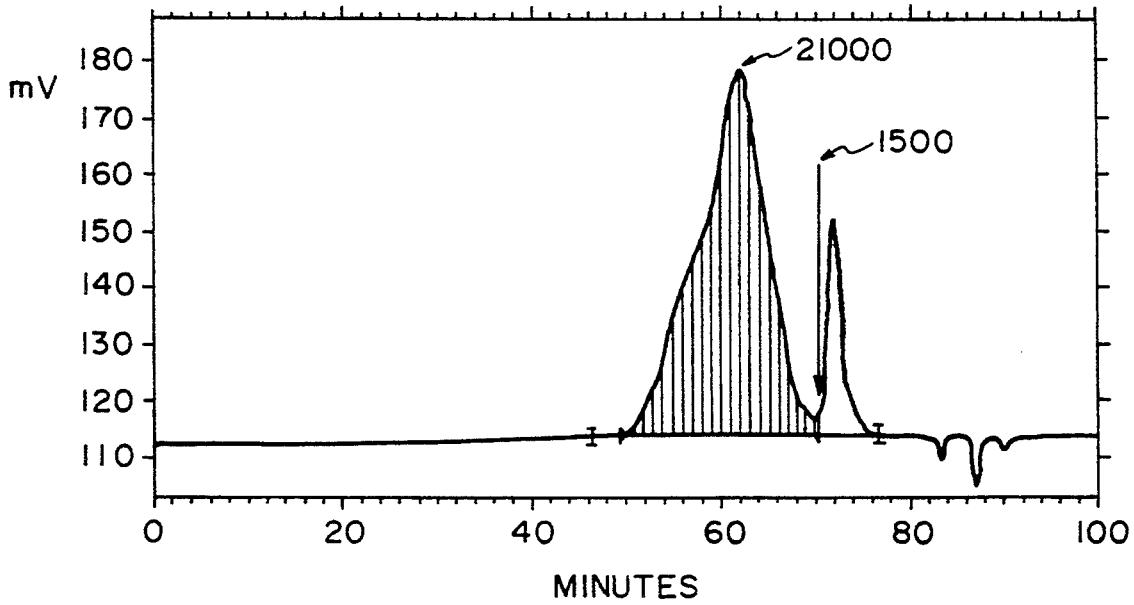

FIG. 5 shows a chromatogram obtained when the region corresponding to a molecular weight of not more than 1,500 is deleted from the chromatogram shown in FIG. 4 and data are calculated. In the chromatogram shown in FIG. 5, the weight average molecular weight (Mw) is 62,000, the number average molecular weight (Mn) is 17,000, and the value-B of Mw/Mn is 3.6. Therefore the value-A of Mw/Mn is larger than the value-B by 5.7.

The toner of the present invention becomes suitable for the heat-pressure fixing when such conditions are met.

In the suspension polymerization, it is preferred that the wax contained in the polymerizable monomer composition is dissolved in the polymerizable monomers, and further that the polymerization is carried out at a temperature not higher than the melting point of the wax. Additionally, the polymerization process is so controlled that the the wax is made to be gradually deposited with progress of the polymerization process and thus is enclosed in the center of each toner particle.

The molecular weight distribution of the toner of the present invention is measured, for example, in the following way.

Preparation of sample (i) Standard sample:

As standard samples, commercially available standard polystyrene as shown below are used. Molecular weight: $8.42\times10^6$, $4.48\times10^6$, $2.98\times10^6$, $1.09\times10^6$, $7.06\times10^5$, $3.55\times10^5$, $1.90\times10^5$, $9.64\times10^4$, $3.79\times10^4$, $1.96\times10^4$, $9.10\times10^3$, $5.57\times10^3$, $2.98\times10^3$, 870, 500 (available from Toyo Soda Manufacturing Co., Ltd.).

About 3 mg each of the above each standard polystyrenes is dissolved in 30 ml of tetrahydrofuran to give a standard sample.

(ii) Preparation of test sample:

An aliquot (60 mg) of a sample (a toner) is extracted with 15 ml of THF, followed by centrifugal precipitation and then filtration to give a sample for the measurement of molecular weight.

Measuring conditions

As a measuring apparatus, 150 C ALC/GPC, manufactured by Waters Co, is used to measure the molecular weight under the following conditions:

Solvent: THF

Columns: Shodex KF-801, 802, 803, 804, 805, 806, 807 (available from Showa Denko K.K.)

Temperature: 40° C.

Flow rate: 1.0 ml/min.

Pour: 0.1 ml

Detector: RI

Data processing

Under the above measuring conditions, the retention time of the standard sample is read to prepare a calibration curve, and the molecular weight of the sample is calculated from the calibration curve.

The coloring agent contained in the toner of the present invention may include dyes or pigments.

For example, it may include phthalocyanine pigments, azo pigments, quinacridone pigments, xanthene dyes, and carbon black.

The coloring agent should be used in an amount of from 0.5 to 40 parts by weight, and preferably 1 to 25 parts by weight, based on 100 parts by weight of the resin component. A charge control material may optionally be added to the toner. For example, charge control materials such as a metal complex salt of an azine dye or monoazo dye containing an alkyl group having 2 to 16 carbon atoms, and a metal complex salt of salicylic acid or dialkylsalicylic acid.

In the case of the azine dye, it may preferably be used in such a very small amount (e.g., not more than 0.3% by weight, and more preferably 0.05% by weight to 0.2% by weight) so as to not damage color tones of color toners such as a cyan toner, a magenta toner and a yellow toner.

The agglomeration of the toner of the present invention may preferably be not more than 40%, and preferably 1% to 30%, even after it has been left at a temperature of 50° C. for 48 hours. The degree of agglomeration after leaving at 50° C. for 48 hours is regarded as one of the barometers of the anti-blocking properties of toners and the wax enclosure in the toner particle. When a toner with poor anti-blocking properties is left at a temperature of 50° C. for 48 hours, the toner agglomerates into a mass, resulting in a large value for the degree of agglomeration.

The degree of agglomeration of the toner or a toner mixed with an additive such as hydrophobic colloidal silica can be measured by the following method.

Measurement of degree of agglomeration:

A sample (a toner or a toner mixed with an additive such as hydrophobic colloidal silica is left in an environment of 23° C. for about 12 hours for measurement. Measurement is made in an environment of a temperature of 23° C. and a humidity of 60% RH.

In the meantime, 5 g of the sample is put in an 100 ml polyethylene container, and left at a temperature of 50° C. for 48 hours. After that, the degree of agglomeration of the sample is measured.

As a measuring apparatus, Powder Tester (trade name; manufactured by Hosokawa Micron Corporation) is used.

To make the measurement, 200 mesh, 100 mesh and 60 mesh sieves are overlaid on a vibrating pedestal in this order from the bottom according to the mesh size so that the 60 mesh sieve is uppermost.

On the 60 mesh sieve of the sieves set in this way, 5 g of sample precisely weighed is placed, the input voltage applied to the vibrating pedestal is set to 21.7 V, and the vibrational amplitude of the vibrating pedestal is so adjusted as to be within the range of 60μ to 90μ (rheostat gauge: about 2.5), and the sieves are vibrated for about 15 seconds. The weight of the sample that remained on each sieve is measured to calculate the degree of agglomeration according to the following expression:

$$\text{Degree of agglomeration (\%)} = \frac{\text{Sample weight on 60 mesh sieve}}{5\text{ g}} \times 100 + \frac{\text{Sample weight on 100 mesh sieve}}{5\text{ g}} \times 100 \times 3/5 + \frac{\text{Sample weight on 200 mesh sieve}}{5\text{ g}} \times 100 \times 1/5$$

In the toner used in the present invention, a fluidity improver may be added to the external surfaces of the color toner particles. The fluidity improver may include fine colloidal silica powder, hydrophobic fine colloidal silica powder, fine titanium oxide powder, hyrophobic fine titanium oxide powder, fatty acid metal, salt powder, and fine Teflon powder.

The toner of the present invention may preferably have a flow-out point at 75° C. to 95° C. in view of color mixing performance required for a full-color image fixation.

Figure 8:
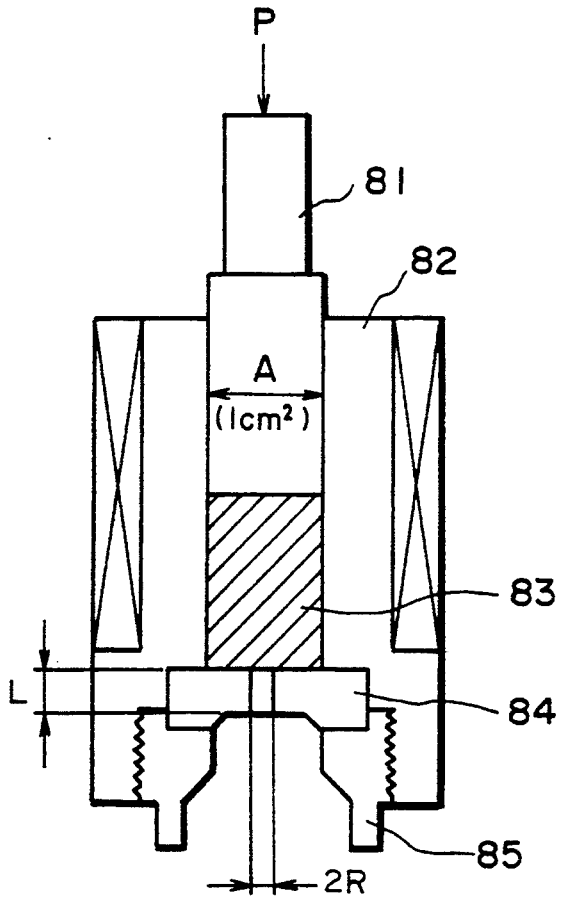
FIG. 8 is a schematic illustration of a flow tester.
Figure 9:
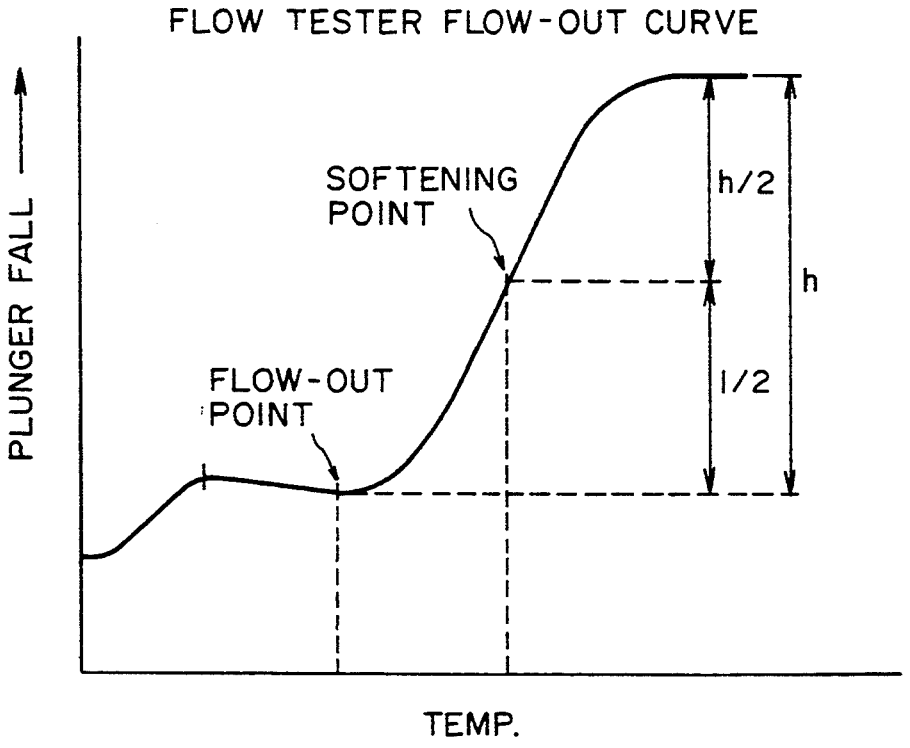
FIG. 9 shows a flow-out curve of a toner, measured by the flow tester.

The melt behavior of the toner used in the present invention can be measured using an overhead-type flow tester as illustrated in FIG. 8 (Shimadzu Flow Tester CFT-500 Type). In the first place, 1.5 g of a sample 83 molded by a pressure molder is extruded from a nozzle 84 of 1 mm in diameter and 1 mm in length under application of a load of 20 kgf using a plunger 1 under the temperatures elevation at a rate of 5.0° C./min and thus the distance of the plunger fall is measured.

Here, in the plunger fall quantity-temperature curve of the flow tester, the temperature at which the sample begins to flow out is regarded as the flow-out temperature.

The toner obtained by the method described above can be applied to dry electrostatic image development. For example, it can be applied to two-component development such as cascade development, magnetic brush development, micro-toning development and two-component AC bias development; one-component development making use of magnetic toners, such as conductive one-component development, insulating one-component development, and jumping development; powder cloud development and fur brush development; non-magnetic magnetic one-component development in which a toner is held on a toner carrying member by the action of an electrostatic force to be transported to a developing zone and used for development; and electric field curtain development in which a toner is transported to a developing zone by the electric field curtain method and used for development. The toner obtained by the method described above can be particularly useful in development processes requiring a sharp particle size distribution, making use of a small-diameter toner with a weight average particle diameter (d4) of about 2 μm to 8.5 μm.

In the present invention, a fluidity improver may preferably be used by its mixture in toner particles. The fluidity improver can be exemplified by fine colloidal silica powder, hydrophobic fine colloidal silica powder, fine fatty acid metal salt powder, fine Teflon powder, fine titanium oxide powder, and hydrophobic fine titanium oxide powder.

The particle size distribution of toners can be measured by various methods. In the present invention, it is measured using a Coulter counter.

A Coulter counter Type-II (manufactured by Coulter Electronics, Inc.) is used as a measuring device. An interface (manufactured by Nikkaki) and a personal computer CX-I (manufactured by Canon Inc.) are connected for the output of number distribution and volume distribution. As an electrolytic solution, an aqueous 1% NaCl solution is prepared using first-grade sodium chloride. For example, ISOTON-II (trade name; available from Coulter Scientific Japan Ltd.) can be used. Measurement is carried out by adding as a dispersant 0.1 to 5 ml of a surface active agent (preferably an alkylbenzene sulfonate) to 100 ml to 150 ml of the above aqueous electrolytic solution, and further adding 2 to 20 mg of a sample to be measured. The electrolytic solution in which the sample has been suspended is subjected to dispersion for 1 to 3 minutes in an ultrasonic dispersion machine. The 2μ to 40μ particle size distribution is measured on the basis of the number distribution using the above Coulter counter Type TA-II, with an 100μ aperture, and then the values according to the present invention are determined.

The present invention can be more effective for the case of a multi-color image. An example of a method of obtaining the multi-color image will be described with reference to FIG. 6.

Figure 6:
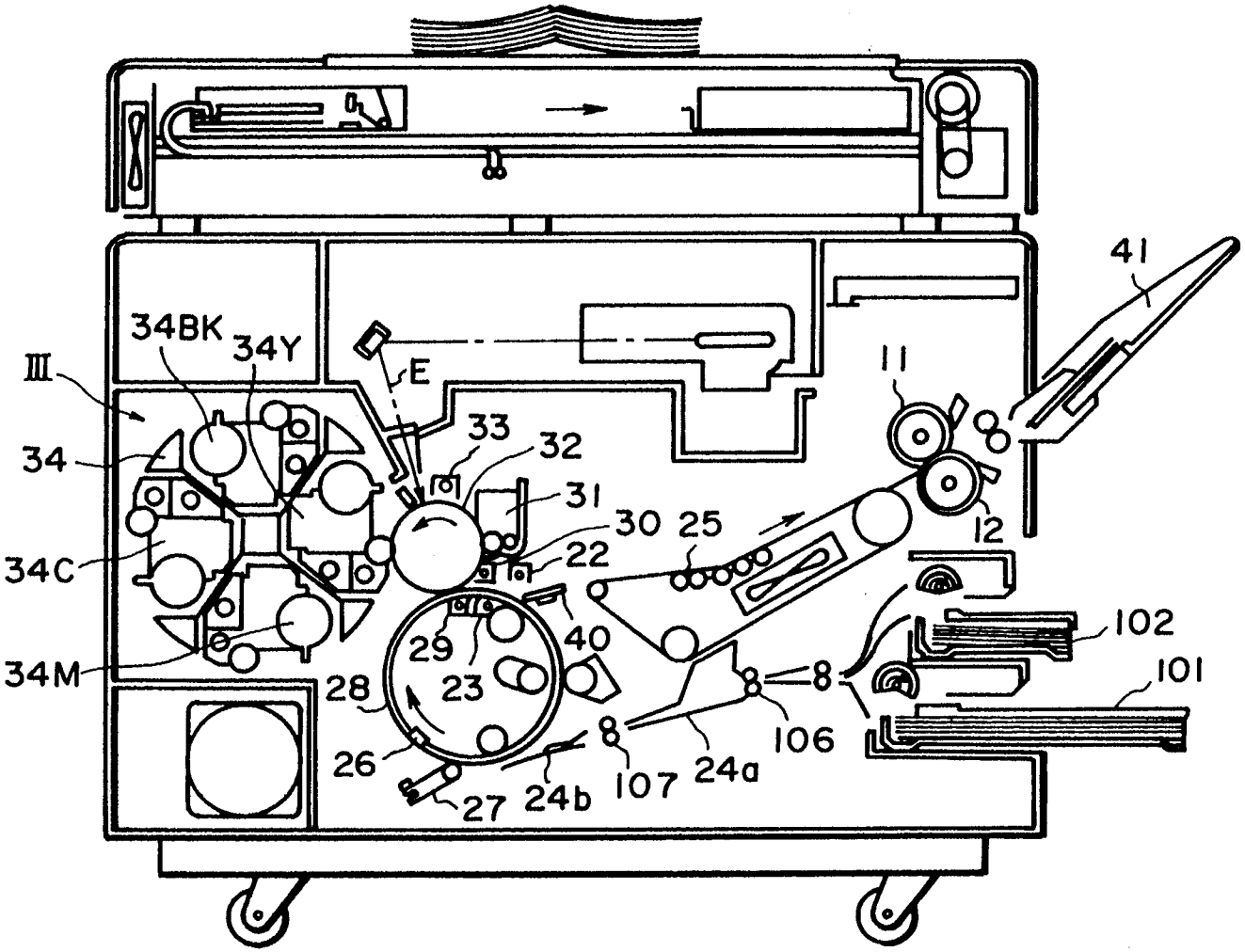
FIG. 6 is a schematic illustration of a full-color copying machine.
Figure 7:
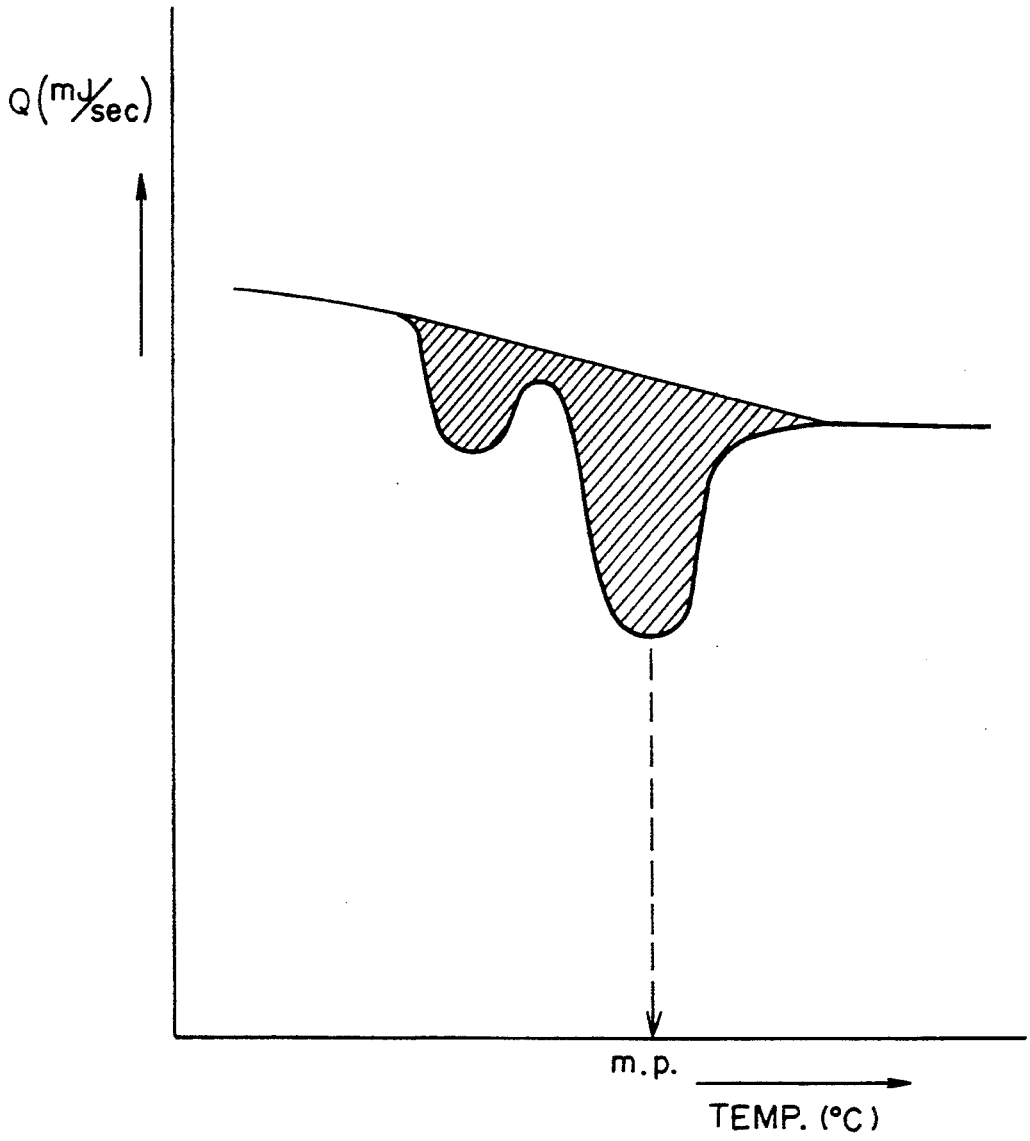
FIG. 7 is a view to illustrate the melting point of the wax used in the present invention.

A photosensitive drum 32 is rotated in the direction of an arrow shown in FIG. 6, and a photosensitive layer formed on the drum 32 is uniformly charged by means of a primary corona assembly 33. Then, the photosensitive layer is image wise exposed to the modulated laser light E corresponding with a yellow image of an original, so that an electrostatic latent image of the yellow image is formed on the photosensitive drum 32. The electrostatic latent image of this yellow image is developed by means of a yellow developer assembly 34Y previously set to a developing position with the rotation of a rotator 34 of a developing device III.

A transfer medium (not shown) transported from a paper feed cassette 101 or 102 through a paper feed guide 24*a*, paper feed roller 107 and a paper feed guide 24*b* is held by a gripper at a given timing, and electrostatically wound to a transfer drum 28 by means of a contacting roller 27 and an electrode opposingly provided thereto. The transfer drum 28 is rotated in the direction shown by an arrow in FIG. 6, in synchronization with the photosensitive drum 32. A visible image formed as a result of the development by the yellow developer assembly 34Y is transferred by means of a transfer corona assembly 29 where the peripheral surface of the photosensitive drum 32 and the peripheral surface of the transfer drum 28 come in contact with each other. The transfer drum 28 continues to rotate preparation for the transfer of a next color (in the case of FIG. 6, magenta).

Meanwhile, the photosensitive drum 32 is charge-eliminated by means of a residual charge eliminator 30 and cleaned by a cleaning means 31. Thereafter, it is again charged by means of the primary corona assembly 33, and then image-wise exposed as before, according to the next (e.g. magenta) image signals. The developing device III is rotated while an electrostatic latent image according to the magenta image signals is formed on the photosensitive drum 32 as a result of the above image-wise exposure, so that a magenta developer assembly 34 M is set to its developing position and the magenta development is carried out. Subsequently, the processes described above are also applied to cyan color development and black color development, respectively. After the images corresponding to the four colors have been completed, the four-color visible image (toner image) formed on the transfer medium is charge-eliminated by means of corona assemblies 22 and 23. The transfer medium is released from the grip of the gripper 26 and at the same time separated from the transfer drum 28 by means of a separating claw 40. It is then delivered through a delivery belt means 25 to an image fixing device provided with a fixing roll 11 and a pressure roll 12, where the image is color-mixed and fixed by the action of heat and pressure. The transfer medium having the image thus fixed comes out to an output-paper tray 41. Thus, a sequence of full-color printing processes are completed, and thus the desired full-color printed image is formed.

The present invention will be described below in greater detail by giving Examples. In the following, "part(s)" refers to "part(s) by weight" (abbreviated to "pbw" in Tables).

EXAMPLE 1

To 1,200 parts by weight of ion-exchanged water, 400 parts of an aqueous 0.1N sodium phosphate solution and 35 parts of aqueous 1N calcium chloride solution were added with stirring to prepare an aqueous dispersion medium containing fine calcium phosphate particles of 1 μm or less in particle diameter. The pH of this aqueous dispersion medium was about 10.

The following materials;

| | |
|---|---|
| Styrene monomer | 183 parts |
| 2-Ethylhexyl acrylate monomer | 17 parts |
| Paraffin wax (m.p.: 75° C.; weight average molecular weight: about 1,000) | 40 parts |
| Pigment yellow 17 | 7 parts |
| Styrene/methacrylic acid/methyl methacrylate copolymer (molar ratio: 88:10:2; weight average molecular weight: 58,000; acid value: 20) | 10 parts |
| Chromium complex of di-tert-butylsalicylic acid | 2 parts |

were heated to a temperature of 60° C. in a container, and dissolved and dispersed using a TK type homomixer (3,000 rpm) to prepare a monomer mixture. The paraffin wax was confirmed to be completely dissolved in this monomer mixture. While the temperature was kept at 60° C., 10 parts of a polymerization initiator, 2,2'-azobis(2,4-dimethylvaleronitrile) (half-life at 60° C.: 240 minutes; temperature for 10 hours half life in toluene: 51° C.) and 1 part of dimethyl-2,2'-azobisisobutyrate (half-life at 60° C.: 2,000 minutes; temperature for 10 hours half-life in toluene: 66° C.) were added to the monomer mixture. Thus a polymerizable monomer composition was prepared.

Into the container holding the above aqueous dispersion medium kept at 60° C., the polymerizable monomer composition thus prepared, kept at a temperature of 60° C., was poured, followed by stirring for 20 minutes in a nitrogen atmosphere at 60° C., using a TK type homomixer and with stirring blade revolution number of 10,000 rpm so that the polymerizable monomer composition was granulated in the aqueous dispersion medium. After the granulation was completed, the the mixture was stirred at 60° C. for 3 hours using a stirring machine (60 rpm) having paddle stirring blades, in place of the TK type homomixer, to allow the polymerization to proceed. Then the temperature of the mixture was raised to 80° C., the polymerization was further allowed to proceed with stirring for 10 hours.

After the polymerization was completed, 50 parts of 5N hydrochloric acid was added to the aqueous dispersion medium containing polymer particles to dissolve the fine calcium phosphate particles, followed by cooling, and then filtration to give polymer particles. The polymer particles thus obtained were washed with water and dried to give a yellow toner-A prepared by suspension polymerization.

The yellow toner-A obtained was measured using a Coulter counter to determine that it had a weight average particle diameter (d4) of 8 μm and also had a sharp particle size distribution.

The flow-out point of this yellow toner-A, measured by a flow tester was 76° C. The surface of pellets obtained by molding this yellow toner-A had a contact angle with water of 103°. Cross sections of the yellow toner particles observed under an electron microscope showed that the paraffin wax was well enclosed in each particle at its center. In the gel permeation chromatogram of the yellow toner-A, the weight average molecular weight (Mw) was 56,000, the number average molecular weight (Mn) was 6,000, and Mw/Mn(value-A) was 9.3. In its gel permeation chromatogram, in the region of a molecular weight of 1,500 or more the Mw was 62,000, the Mn was 17,000, and Mw/Mn (value-B) was 3.6. Also in its gel permeation chromatogram, the weight ratio of the region of a molecular weight of 1,500 or more to the region of a molecular weight of 1,500 to 300 was 210:40.

Then, 100 parts of the resulting yellow toner-A and 0.5 part of a negatively chargeable hydrophobic fine colloidal silica powder (BET specific surface area: about 200 $m^2/g$) were mixed to prepare a yellow toner-A having hydrophobic colloidal silica on its particle surfaces. This yellow toner showed a degree of agglomeration of 7.2% at 23° C., and a degree of agglomeration of 7.5% at 50° C. after 48 hours.

Next, 900 parts of a resin-coated magnetic ferrite carrier (average particle diameter: 45 μm) and 100 parts of the yellow toner were blended to prepare a two-component developer. The toner had negative triboelectric charges after the two-component developer had been shaken in a container.

The two-component developer thus prepared was fed to a modified machine of the full-color copier (CLC-1; manufactured by Canon Inc.) as schematically illustrated in FIG. 6, with successive supplement of the yellow toner-A, having hydrophobic fine colloidal silica powder on the particle surfaces, to carry out image reproduction tests and heat-roller fixing tests. The fixing roller of the fixing test device was a roller of 40 mm in diameter, comprising a mandrel made of aluminum with a diameter of about 34 mm, provided with a heater in its interior, a 2 mm thick HTV silicone rubber layer formed on the surface of the mandrel, and a 30 μm thick PFA resin (tetrafluoroethylene-perfluoroalkyl vinyl ether copolymer) layer on the rubber layer. The surface of the fixing roller had a hardness of 45°. The a pressure roller of the fixing device was roller of 40 mm in diameter, comprising a mandrel made of aluminum with a diameter of about 38 mm, with a heater provided in its interior, and an 1 mm thick fluorine rubber layer around the mandrel. The surface of the pressure roller had a hardness of 55°.

In the above fixing device, the paper output direction was inclined toward the pressure roller as shown in FIG. 2.

The fixing tests were carried out on plain paper under the following conditions: The pressure between the rollers was controlled to be 3 $kg/cm^2$, the fixing process speed was set to be 90 mm/sec, and the temperature was controllable within the temperature range of 100° C. to 200° C. at intervals of 5° C. To make evaluation, a fixed image obtained was rubbed with lens cleaning paper "DUSPER" (trade name; available from OZU Paper Co., Ltd.) under application of a load of 50 $g/cm^2$, and the temperature at which the image density reduction after the rubbing comes to be 5% or less is regarded as a fixing start temperature. Offset resistance was evaluated on the basis of observations of fixed images. Toner images were also fixed on OHP sheets at a process speed of 20 mm/sec at 150° C., and transmission spectrum of each sheet was measured with a spectrophotometer U-3400 (manufactured by Hitachi Ltd.) to evaluate the transparency of the yellow toner image.

Durability tests for the running on a large number of sheets were also carried out at a fixing temperature of 150° C.

Physical properties of the toner and the test results are shown in Tables 1 and 2.

EXAMPLE 2

| | |
|---|---|
| Styrene monomer | 170 parts |
| 2-Ethylhexyl acrylate monomer | 30 parts |
| Paraffin wax (m.p.: 75° C.; Mw: about 1,000) | 40 parts |
| C.I. Pigment Blue 15:3 | 10 parts |
| Styrene/methacrylic acid/methyl methacrylate copolymer (molar ratio: 88:10:2; Mw: 58,000; acid value: 20) | 10 parts |
| Chromium complex of di-tert-butylsalicylic acid | 3 parts |

A cyan toner-B was prepared by suspension polymerization in the same manner as in Example 1 except for using the above materials. Also in the same manner as in Example 1, the cyan toner-B obtained and the negatively chargeable hydrophobic fine colloidal silica powder were mixed, and the resulting mixture was then blended with a resin-coated magnetic ferrite carrier. A two-component developer was thus prepared.

Images were reproduced and toner image fixing tests were carried out in the same manner as in Example 1 except for using the above two-component developer.

Physical properties of the toner and the test results are shown in Tables 1 and 2.

EXAMPLE 3

| | |
|---|---|
| Styrene monomer | 170 parts |
| 2-Ethylhexyl acrylate monomer | 30 parts |
| Paraffin wax (m.p.: 75° C.; Mw: about 1,000) | 40 parts |
| C.I. Pigment Red 122 | 7 parts |
| Styrene/methacrylic acid/methyl methacrylate copolymer (molar ratio: 88:10:2; Mw: 58,000; acid value: 20) | 10 parts |
| Chromium complex of di-tert-butylsalicylic acid | 3 parts |

A magenta toner-C was prepared by suspension polymerization in the same manner as in Example 1 except for using the above materials. Also in the same manner as in Example 1, the magenta toner-C obtained and the negatively chargeable hydrophobic fine colloidal silica powder were mixed, and the resulting mixture was then blended with the resin-coated magnetic ferrite carrier. A two-component developer was thus prepared.

Images were reproduced and toner image fixing tests were carried out in the same manner as in Example 1 except for using the above two-component developer.

Physical properties of the toner and the test results are shown in Tables 1 and 2.

EXAMPLE 4

| | |
|---|---|
| Styrene monomer | 170 parts |
| 2-Ethylhexyl acrylate monomer | 30 parts |
| Paraffin wax (m.p.: 75° C.; Mw: about 1,000) | 40 parts |
| Carbon black (average particle diameter: 36 mμ; volatile matter: 1% by weight) | 20 parts |
| Aluminum coupling agent | 0.2 part |
| Styrene/methacrylic acid/methyl methacrylate copolymer (molar ratio: 88:10:2; Mw: 58,000; acid value: 20) | 10 parts |
| Chromium complex of di-tert-butylsalicylic acid | 3 parts |

A black toner-D was prepared by suspension polymerization in the same manner as in Example 1 except for using the above materials. Also in the same manner as in Example 1, the black toner-D obtained and the negatively chargeable hydrophobic fine colloidal silica powder were mixed, and the resulting mixture was then blended with the resin-coated magnetic ferrite carrier. A two-component developer was thus prepared.

Images were reproduced and toner image fixing tests were carried out in the same manner as in Example 1 except for using the above two-component developer.

Physical properties of the toner and the test results are shown in Tables 1 and 2.

EXAMPLE 5

A yellow toner-E was prepared in the same manner as in Example 1 except that the amount of the paraffin wax was changed to 95 parts. Also in the same manner as in Example 1, the yellow toner-E obtained and the negatively chargeable hydrophobic fine colloidal silica powder were mixed, and the resulting mixture was then blended with the resin-coated magnetic ferrite carrier. A two-component developer was thus prepared.

Images were reproduced and toner image fixing tests were carried out in the same manner as in Example 1 except for using the above two-component developer.

Physical properties of the toner and the test results are shown in Tables 1 and 2.

EXAMPLE 6

A yellow toner-F was prepared in the same manner as in Example 1 except that the amount of the paraffin wax was changed to 22 parts. Also in the same manner as in Example 1, the yellow toner-F obtained and the negatively chargeable hydrophobic fine colloidal silica powder were mixed, and the resulting mixture was then blended with the resin-coated magnetic ferrite carrier. A two-component developer was thus prepared.

Images were reproduced and toner image fixing tests were carried out in the same manner as in Example 1 except for using the above two-component developer.

Physical properties of the toner and the test results are shown in Tables 1 and 2.

EXAMPLE 7

A yellow toner-G was prepared in the same manner as in Example 1 except for using paraffin wax with a melting point of 60° C. Also in the same manner as in Example 1, the yellow toner-G obtained and the negatively chargeable hydrophobic fine colloidal silica powder were mixed, and the resulting mixture was then blended with the resin-coated magnetic ferrite carrier. A two-component developer was thus prepared.

Images were reproduced and toner image fixing tests were carried out in the same manner as in Example 1 except for using the above two-component developer.

Physical properties of the toner and the test results are shown in Tables 1 and 2.

EXAMPLE 8

A yellow toner-H was prepared in the same manner as in Example 1 except for using paraffin wax with a melting point of 100° C. Also in the same manner as in Example 1, the yellow toner-H obtained and the negatively chargeable hydrophobic fine colloidal silica powder were mixed, and the resulting mixture was then blended with the resin-coated magnetic ferrite carrier. A two-component developer was thus prepared.

Images were reproduced and toner image fixing tests were carried out in the same manner as in Example 1 except for using the above two-component developer.

Physical properties of the toner and the test results are shown in Tables 1 and 2.

EXAMPLE 9

| | |
|---|---|
| Styrene monomer | 183 parts |
| 2-Ethylhexyl acrylate monomer | 17 parts |
| Paraffin wax (m.p.: 75° C.; Mw: about 1,000) | 30 parts |
| Pigment Yellow 17 | 7 parts |
| Styrene/methacrylic acid/methyl methacrylate copolymer (molar ratio: 88:10:2; Mw: 100,000; acid value: 20) | 20 parts |
| Chromium complex of di-tert-butylsalicylic acid | 2 parts |

A yellow toner-I was prepared by suspension polymerization in the same manner as in Example 1 except for using the above materials. Also in the same manner as in Example 1, the yellow toner-I obtained and the negatively chargeable hydrophobic fine colloidal silica powder were mixed, and the resulting mixture was then blended with the resin-coated magnetic ferrite carrier. A two-component developer was thus prepared.

Images were reproduced and toner image fixing tests were carried out in the same manner as in Example 1 except for using the above two-component developer.

Physical properties of the toner and the test results are shown in Tables 1 and 2.

EXAMPLE 10

Toner image fixing tests were carried out in the same manner as in Example 1 except that the pressure between the fixing roller and the pressure roller was changed to 5 kg/cm$^2$. The same good results as in Example 1 were obtained.

EXAMPLE 11

Toner images were formed using the two-component developer having the yellow toner-A prepared in Example 1, the two-component developer having the cyan toner-B prepared in Example 2 and the two-component developer having the magenta toner-C prepared in Example 3, and also using the modified machine of the copier shown in FIG. 6. Fixation was carried out in the same manner as in Example 1 to form a full-color image fixation. In the fixing for the full-color image, the same good results as in Example 1 were obtained.

EXAMPLE 12

Toner image fixing tests were carried out in the same manner as in Example 1 except that the fixing roller is provided with a PTFE layer instead of a PFA layer. The same good results as in Example 1 were obtained.

TABLE 1

| | | Vinyl resin component | | Wax | | |
|---|---|---|---|---|---|---|
| Example: | Toner | Monomer (pbw) | Polar material (pbw) | Mw | m.p. (°C.) | Content (Wax/vinyl resin) |
| 1 | A | St 183<br>2EHAc 17 | ST-MA-MMA<br>10 | 1,000 | 75 | 40/210<br>(= 19/100) |
| 2 | B | St 170<br>2EHAc 30 | ST-MA-MMA<br>10 | 1,000 | 75 | 40/210<br>(= 19/100) |
| 3 | C | St 170<br>2EHAc 30 | ST-MA-MMA<br>10 | 1,000 | 75 | 40/210<br>(= 19/100) |
| 4 | D | St 170<br>2EHAc 30 | ST-MA-MMA<br>10 | 1,000 | 75 | 40/210<br>(= 19/100) |
| 5 | E | St 183<br>2EHAc 17 | ST-MA-MMA<br>10 | 1,000 | 75 | 95/210<br>(= 45/100) |
| 6 | F | St 183<br>2EHAc 17 | ST-MA-MMA<br>10 | 1,000 | 75 | 22/210<br>(= 10/100) |
| 7 | G | St .183<br>2EHAc 17 | ST-MA-MMA<br>10 | 650 | 60 | 40/210<br>(= 19/100) |
| 8 | H | St 183<br>2EHAc 17 | ST-MA-MMA<br>10 | 1,500 | 100 | 40/210<br>(= 19/100) |
| 9 | I | St 183<br>2EHAc 17 | ST-MA-MMA<br>20 | 1,000 | 75 | 30/210<br>(= 19/100) |

| | | GPC data of toner | | | | Col- | Degree of agglomrn. | |
|---|---|---|---|---|---|---|---|---|
| Example: | Toner | Mw | Mn | Mw/Mn | Mw/Mn (1) | oring agent | 23° C., 60% RH | 48* hrs. 50° C. |
| 1 | A | 56,000 | 6,000 | 9.3 | 3.6 | PY17 | 7.2 | 7.5 |
| 2 | B | 59,000 | 6,000 | 9.8 | 3.8 | PB13:3 | 8.3 | 8.0 |
| 3 | C | 52,000 | 6,000 | 8.7 | 3.4 | PR122 | 11.5 | 10.9 |
| 4 | D | 53,000 | 6,000 | 8.8 | 3.4 | CB | 8.2 | 8.5 |
| 5 | E | 50,000 | 4,100 | 12.2 | 3.2 | PY17 | 13.1 | 14.0 |
| 6 | F | 56,000 | 6,700 | 8.4 | 3.6 | PY17 | 6.2 | 7.1 |
| 7 | G | 58,000 | 5,500 | 10.5 | 3.8 | PY17 | 10.0 | 8.6 |
| 8 | H | 49,000 | 6,000 | 8.2 | 3.2 | PY17 | 12.0 | 13.5 |
| 9 | I | 54,000 | 6,000 | 9.0 | 3.5 | PY17 | 6.4 | 6.0 |

(1): of the component with molecular weight of ≧1,500
*After 48 hours at 50° C.
St: Styrene
EHAc: 2-Ethylhexyl acrylate
MA: Methacrylic acid
MMA: Methyl methacrylate
PY: Pigment Yellow
PB: C.I. Pigment Blue
PR: C.I. Pigment Red
CB: Carbon black

TABLE 2

| Example: | Toner | Fixing device: Fixing roller surface material | Pressure roller surface material | Pressure (kg/cm²) | Paper output direction |
|---|---|---|---|---|---|
| 1 | A | PFA | Fluorine rubber | 3 | Pressure r. side |
| 2 | B | PFA | Fluorine rubber | 3 | Pressure r. side |
| 3 | C | PFA | Fluorine rubber | 3 | Pressure r. side |
| 4 | D | PFA | Fluorine rubber | 3 | Pressure r. side |
| 5 | E | PFA | Fluorine rubber | 3 | Pressure r. side |
| 6 | F | PFA | Fluorine rubber | 3 | Pressure r. side |
| 7 | G | PFA | Fluorine rubber | 3 | Pressure r. side |
| 8 | H | PFA | Fluorine rubber | 3 | Pressure r. side |
| 9 | I | PFA | Fluorine rubber | 3 | Pressure r. side |

| Example: | Toner | Wind-around resistance | Fixing start temp. (°C.) | Fixing temp. range (°C.) | Running durability (sheets) | Transparency to OHP film |
|---|---|---|---|---|---|---|
| 1 | A | A | 115 | 115–175 | ≧20,000 | A |
| 2 | B | A | 120 | 120–180 | ≧20,000 | — |
| 3 | C | A | 120 | 120–175 | ≧20,000 | — |
| 4 | D | A | 120 | 120–180 | ≧20,000 | — |
| 5 | E | A | 115 | 115–190 | ≧20,000 | C |
| 6 | F | B | 115 | 115–165 | ≧20,000 | A |
| 7 | G | B | 115 | 115–165 | ≧20,000 | B |
| 8 | H | A | 120 | 120–180 | ≧20,000 | A |
| 9 | I | A | 120 | 120–180 | ≧20,000 | A |

PFA: Tetrafluoroethylene/perfluoroalkyl vinyl ether copolymer
Wind-around resistance (to fixing roller):
A: Excellent, B: Good, C: Passable, F: Failure
Transparency on OHP film:
(in 600 nm light transmittance)
A: ≧70%, B: 60–70%, C: 50–60%, D: <50%

| | |
|---|---|
| Styrene monomer | 183 parts |
| 2-Ethylhexyl acrylate monomer | 17 parts |
| Paraffin wax (m.p.: 75° C.) | 4 parts |
| Pigment Yellow 17 | 7 parts |
| Styrene/methacrylic acid/methyl methacrylate copolymer | 10 parts |
| Chromium complex of di-tert-butylsalicylic acid | 2 parts |

A yellow toner-L was prepared by suspension polymerization in the same manner as in Example 1 except for using the above materials. Also in the same manner as in Example 1, the yellow toner-L obtained and the negatively chargeable hydrophobic fine colloidal silica powder were mixed, and the resulting mixture was then blended with the resin-coated magnetic ferrite carrier. A two-component developer was thus prepared.

Differing from the one used in Example 1, the fixing roller of Comparative Example 1, had a fluorine rubber/Teflon coat (tetrafluoroethylene resin, PTFE) double-layered type construction with a surface hardness of 70°, a layer thickness of 1.0 mm and a roller diameter of 40 mm. The pressure roller had a silicone rubber (HTV) single-layer with a surface hardness of 55°, a layer thickness of 5.0 mm, and a roller diameter of 40 mm. The fixing roller and the pressure roller were in contact at a pressure of 3 kg/cm². Heating devices were fitted in both the fixing roller and the pressure roller. In a blank-paper feeding test using this fixing device, the paper output direction was inclined toward the fixing roller.

Images were reproduced and toner image fixing tests were carried out in the same manner as in Example 1 except for using the above two-component developer and fixing device. Physical properties of the toner and the test results are shown in Tables 3 and 4.

COMPARATIVE EXAMPLE 2

A fixing device different from the one used in Example 1 was used. The fixing roller had a silicone rubber double-layer (RTV/HTV) with a rubber layer thickness of 1 mm, a surface hardness of 55°, and a roller diameter of 40 mm, and the pressure roller a roller of a silicone rubber layer with a surface hardness of 45°, a layer thickness of 3 mm, and a roller diameter of 40 mm. The fixing roller and the pressure roller were in contact at a pressure of 3 kg/cm². Heating devices were fitted in both the fixing roller and the pressure roller. In a blank-paper feeding test using this fixing device, the paper output direction was inclined toward the fixing roller.

Images were reproduced and toner image fixing tests were carried out in the same manner as in Example 1 except for using the two-component developer prepared in Comparative Example 1 and the above fixing device. Test results are shown in Table 4.

COMPARATIVE EXAMPLE 3

Images were reproduced in the same manner as in Example 1 except for using the two-component developer prepared in Comparative Example 1, and toner image fixing tests were carried out in the same manner as in Example 1. Test results are shown in Table 4.

COMPARATIVE EXAMPLE 4

Images were reproduced using the two-component developer prepared in Example 1 and toner image fixing tests were carried out in the same manner as in Example 1 except for using the fixing device used in Comparative Example 1. Test results are shown in Table 4.

COMPARATIVE EXAMPLE 5

| | |
|---|---|
| Styrene monomer | 183 parts |
| 2-Ethylhexyl acrylate monomer | 17 parts |
| Paraffin wax (m.p.: 75° C.) | 120 parts |
| Pigment Yellow 17 | 7 parts |
| Styrene/methacrylic acid/methyl methacrylate copolymer | 10 parts |
| Chromium complex of di-tert-butylsalicylic acid | 2 parts |

A yellow toner-M was prepared by suspension polymerization in the same manner as in Example 1 except for using the above materials. Also in the same manner as in Example 1, the yellow toner-M obtained and the negatively chargeable hydrophobic fine colloidal silica powder were mixed, and the resulting mixture was then blended with the resin-coated magnetic ferrite carrier. A two-component developer was thus prepared.

Images were reproduced and toner image fixing tests were carried out in the same manner as in Example 1 except for using the above two-component developer and the fixing device used in Comparative Example 1. Physical properties of the toner and the test results are shown in Tables 3 and 4.

COMPARATIVE EXAMPLE 6

Images were reproduced and toner image fixing tests were carried out in the same manner as in Example 1 except for using the two-component developer prepared in Comparative Example 5 and the fixing device used in Comparative Example 2. Test results are shown in Table 4.

COMPARATIVE EXAMPLE 7

Images were reproduced and toner image fixing tests were carried out in the same manner as in Example 1 except for using the two-component developer prepared in Comparative Example 5 and the fixing device used in Comparative Example 3. Test results are shown in Table 4.

COMPARATIVE EXAMPLE 8

| | |
|---|---|
| Styrene monomer | 183 parts |
| 2-Ethylhexyl acrylate monomer | 17 parts |
| Divinylbenzene | 1 part |
| Paraffin wax (m.p.: 75° C.) | 4 parts |
| Pigment Yellow 17 | 7 parts |
| Styrene/methacrylic acid/methyl methacrylate copolymer | 10 parts |
| Chromium complex of di-tert-butylsalicylic acid | 2 parts |

A yellow toner-N was prepared by suspension polymerization in the same manner as in Example 1 except for using the above materials. Also in the same manner as in Example 1, the yellow toner-N obtained and the negatively chargeable hydrophobic fine colloidal silica powder were mixed, and the resulting mixture was then blended with the resin-coated magnetic ferrite carrier. A two-component developer was thus prepared.

Images were reproduced and toner image fixing tests were carried out in the same manner as in Example 1 except for using the above two-component developer. Physical properties of the toner and the test results are shown in Tables 3 and 4.

COMPARATIVE EXAMPLE 9

A yellow toner-O was prepared in the same manner as in Example 1 except for using a wax with a molecular weight of 500 and a melting point of 50° C., and then 100 parts of the yellow toner-O obtained and 0.5 part of a hydrophobic fine colloidal silica powder were mixed to prepare a yellow toner.

This yellow toner showed a degree of agglomeration of 16.1% in an environment of a temperature of 23° C. and a humidity of 60% RH, and a degree of agglomeration of 55.4% after it had been left at 50° C. for 48 hours. This toner was inferior in blocking resistance compared with that of Example 1.

COMPARATIVE EXAMPLE 10

A yellow toner-P was prepared in the same manner as in Example 1 except for using a wax with the molecular weight of 2,000 and a melting point of 120° C. The toner thus obtained had a broader particle size distribution than the toner of Example 1, and showed a poor development performance.

COMPARATIVE EXAMPLE 11

Differing from the one used in Example 1, the fixing roller of Comparative Example 11 had a silicone rubber double-layer (RTV/HTV) with a rubber layer thickness of 3 mm, a surface hardness of 45°, and a roller diameter of 40 mm, and the pressure roller had a silicone rubber layer with a surface hardness of 55°, a layer thickness of 1 mm, and a roller diameter of 40 mm. The fixing roller and the pressure roller were in contact at a pressure of 3 kg/cm$^2$. Heating devices were fitted in both the fixing roller and the pressure roller. In a blank-paper feeding test using this fixing device, the paper output direction was inclined toward the pressure roller.

Images were reproduced and toner image fixing tests were carried out in the same manner as in Example 1 except for using the above fixing device. Test results are shown in Table 4.

COMPARATIVE EXAMPLE 12

Image fixing tests were carried out in the same manner as in Example 1 except that the fixing roller and the pressure roller were brought in contact at a pressure of 1 kg/cm$^2$. Test results are shown in Table 4.

TABLE 3

| Comparative Example: | Toner | Vinyl resin component: Monomer (pbw) | Vinyl resin component: Polar material (pbw) | Wax: Mw | Wax: m.p. (°C.) | Wax: Content (Wax/vinyl resin) |
|---|---|---|---|---|---|---|
| 1 | L | St 183 | ST-MA-MMA | 1,000 | 75 | 4/210 |
| | | 2EHAc 17 | 10 | | | (= 1.9/100) |
| 5 | M | St 183 | ST-MA-MMA | 1,000 | 75 | 120/210 |
| | | 2EHAc 17 | 10 | | | (= 57/100) |
| 8 | N | St 183 | ST-MA-MMA | 1,000 | 75 | 4/210 |
| | | 2EHAc 17 | 10 | | | (= 1.9/100) |
| | | DVB 1 | | | | |
| 9 | O | St 183 | ST-MA-MMA | 500 | 50 | 40/210 |
| | | 2EHAc 17 | 10 | | | (= 19/100) |
| 10 | P | St 183 | ST-MA-MMA | 2,000 | 120 | 40/210 |
| | | 2EHAc 17 | 10 | | | (= 19/100) |

| Comparative Example: | Toner | GPC data of toner: Mw | Mn | Mw/Mn | Mw/Mn (1) | Coloring agent | Degree of agglomrn. 23° C., 60% RH | Degree of agglomrn. 48* hrs. 50° C. |
|---|---|---|---|---|---|---|---|---|
| 1 | L | 60,000 | 8,000 | 7.5 | 3.8 | PY17 | 7.1 | 6.8 |
| 5 | M | 49,000 | 3,900 | 12.6 | 3.2 | PY17 | 12.0 | 13.5 |
| 8 | N | 600,000 | 15,000 | 40 | 35 | PY17 | 8.4 | 7.0 |
| 9 | O | 52,000 | 5,000 | 10.4 | 3.6 | PY17 | 16.1 | 55.4 |

TABLE 3-continued

| | | | | | | | | |
|---|---|---|---|---|---|---|---|---|
| 10 | P | 56,000 | 6,500 | 8.6 | 3.3 | PY17 | 7.9 | 6.2 |

(1): of the component with molecular weight of ≧1,500
* After 48 hours at 50° C.
St: Styrene
2EHAc: 2-Ethylhexyl acrylate
DVB: Divinylbenzene
MA: Methacrylic acid
MMA: Methyl methacrylate
PY: Pigment Yellow

TABLE 4

| | | Fixing device | | | |
|---|---|---|---|---|---|
| Comparative Example: | Toner | Fixing roller surface material | Pressure roller surface material | Pressure (kg/cm$^2$) | Paper output direction |
| 1 | L | PTFE | Silicone rubber | 3 | Fixing r. side |
| 2 | L | Silicone rubber | Fluorine rubber | 3 | Fixing r. side |
| 3 | L | PFA | Fluorine rubber | 3 | Pressure r. side |
| 4 | A | PTFE | Silicone rubber | 3 | Fixing r. side |
| 5 | M | PTFE | Silicone rubber | 3 | Fixing r. side |
| 6 | M | Silicone rubber | Fluorine rubber | 3 | Fixing r. side |
| 7 | M | PFA | Fluorine rubber | 3 | Pressure r. side |
| 8 | N | PFA | Fluorine rubber | 3 | Pressure r. side |
| 9 | O | PFA | Fluorine rubber | 3 | Pressure r. side |
| 10 | P | PFA | Fluorine rubber | 3 | Pressure r. side |
| 11 | A | Silicone rubber | Fluorine rubber | 3 | Pressure r. side |
| 12 | A | PFA | Fluorine rubber | 1 | Pressure r. side |

| Comparative Example: | Toner | Wind-around resistance | Fixing start temp. (°C.) | Fixing temp. range (°C.) | Running durability (sheets) | Transparency to OHP film |
|---|---|---|---|---|---|---|
| 1 | L | F | 115 | 115–125 | — | — |
| 2 | L | F | 115 | 115–125 | — | — |
| 3 | L | F | 115 | 115–130 | — | — |
| 4 | A | C | 115 | 115–155 | ≧20,000 | A |
| 5 | M | A | 110 | 110–160 | ≧20,000 | F |
| 6 | M | A | 110 | 110–160 | ≧20,000 | F |
| 7 | M | A | 110 | 110–170 | ≧20,000 | F |
| 8 | N | c | 150 | 150–220 | 500* | F |
| 9 | O | A | 110 | 110–155 | ≧20,000 | B |
| 10 | P | C | 140 | 140–210 | ≧20,000 | — |
| 11 | A | A | 115 | 115–175 | 10,000* | A |
| 12 | A | A | 120 | 120–160 | ≧20,000 | A |

*Contamination of fixing roller occurred.
PFA: Tetrafluoroethylene/perfluoroalkyl vinyl ether copolymer
PTFE: Polytetrafluoroethylene
Wind-around resistance (to fixing roller):
A: Excellent, B: Good, C: Passable, F: Failure
Transparency on OHP film:
(in 600 nm light transmittance)
A: ≧70%, B: 60–70%, C: 50–60%, D: ≧50%

We claim:

1. A heat-pressure fixing method comprising;

transferring to a transfer medium a negatively charged toner image formed on an electrostatic-image bearing member, said toner containing a wax with a weight average molecular weight (Mw) of from 500 to 1,500 and a melting point of from 55° C. to 100° C., in an amount of from 10 parts by weight to 50 parts by weight based on 100 parts by weight of a vinyl resin; said wax being enclosed in each toner particle by said vinyl resin, wherein the molecular weight distribution of a tetrahydrofuran(THF)-soluble matter measured by gel permeation chromatography, the weight average molecular weight (Mw) is from 10,000 to 500,000, the number average molecular weight (Mn) is from 1,000 to 100,000, the Mw/Mn (value-A) is from 4 to 20, and the Mw/Mn (value-B) for THF-soluble matter in the region of a molecular weight of not less than 1,500, is from 2 to 10; and fixing said toner image on the transfer medium by the use of a fixing means comprising a fixing roller and a pressure roller that are so provided as to be in mutual pressure contact, through which said transfer medium comes out in the direction inclined toward the pressure roller from the line perpendicular to a line connecting the center of the fixing roller and the center of the pressure roller; the pressure applied between the fixing roller and the pressure roller being not less than 2 kg/cm$^2$; and the surface of said fixing roller being made of a material comprising a fluorine-containing material.

2. The method according to claim 1, wherein said toner comprises toner particles formed by suspension polymerization.

3. The method according to claim 1, wherein said toner comprises toner particles formed by suspension polymerization of polymerizable monomer composition containing at least i) 100 parts by weight of a polymerizable monomer, ii) from 10 parts by weight to 50 parts by weight of paraffin wax having a weight average molecular weight of from 500 to 1,500 and a melting point of from 65° C. to 80° C., iii) a coloring agent, iv) a polar material and v) a polymerization initiator.

4. The method according to claim 3, wherein said polymerizable monomer comprises a styrene monomer.

5. The method according to claim 3, wherein said polymerizable monomer comprises a styrene monomer and an acrylate monomer.

6. The method according to claim 3, wherein said polymerizable monomer comprises a styrene monomer and a methacrylate monomer.

7. The method according to claim 1, wherein said fixing roller comprises a mandrel having thereon an elastic layer, and a fluorine resin-coated layer formed on said elastic layer.

8. The method according to claim 1, wherein said pressure roller has a harder surface layer than the fixing roller and has a hardness of not less than 40°.

9. The method according to claim 1, wherein said pressure roller has a harder surface layer than the fixing roller and has a hardness of not less then 50°.

10. The method according to claim 1, wherein said fixing roller has a softer surface layer than the pressure roller and has a hardness of from 30° to 70°.

11. The method according to claim 1, wherein said fixing roller has a softer surface layer than the pressure roller and has a hardness of from 35° to 60°.

12. The method according to claim 1, wherein said toner comprises a chromatic color toner.

13. The method according to claim 1, wherein said toner comprises a yellow toner, a magenta toner and a cyan toner.

14. The method according to claim 1, wherein said fixing roller and pressure roller are each provided with a heater inside of the mandrel.

15. The method according to claim 1, wherein said fixing roller has a diameter of from 30 mm to 90 mm, has an elastic layer with a thickness of from 0.5 mm to 5 mm on its mandrel, and has a fluorine resin layer with a thickness of from 5 μm to 100 μm on the elastic layer.

16. The method according to claim 1, wherein said fixing roller becomes concave at its nip area with the pressure roller.

17. The method according to claim 1, wherein said fixing roller is substantially not coated with a silicone oil.

18. The method according to claim 1, wherein the THF-soluble matter in said toner has a weight average molecular weight (Mw) of from 15,000 to 200,000, a number average molecular weight (Mn) of from 2,000 to 30,000 and the Mw/Mn(value-A) of from 5 to 15.

19. The method according to claim 1, wherein the Mw/Mn (value-B) for the fraction of THF-soluble matter having a molecular weight of not less than 1,500 in a chromatogram obtained by the gel permeation chromatography in said toner is from 2.5 to 8, lesser than Mw/Mn (value-A) by 2 or more.

20. The method according to claim 1, wherein said toner contains a styrene copolymer as a binder resin and a paraffin wax with a melting point of from 65° C. to 80° C., and said fixing roller has a fluorine resin-coated layer.

21. The method according to claim 20, wherein said fixing roller has a PFA resin-coated surface layer.

22. The method according to claim 20, wherein said fixing roller has a PTFE resin-coated surface layer.

23. The method according to claim 1, wherein said toner has a weight average particles diameter of 2 to 10 μm.

24. The method according to claim 1, wherein said toner has a weight average particles diameter of 2 to 8.5 μm.

25. A heat-pressure fixing method comprising:

transferring to a transfer medium a toner image formed of toner on an electrostatic-image bearing member, the toner containing a vinyl resin and a wax, the wax having a weight average molecular weight (Mw) of from 500 to 1,500 and a melting point of from 55° C. to 100° C., and being in an amount of from 10 parts by weight to 50 parts by weight based on 100 parts by weight of the vinyl resin, the wax being enclosed in each toner particle by the vinyl resin, wherein the molecular weight distribution of a tetrahydrofuran (THF)-soluble matter measured by gel permeation chromatography, the weight average molecular weight (Mw) is from 10,000 to 500,000, the number average molecular weight (Mn) is from 1,000 to 100,000, the Mw/Mn (value-A) is from 4 to 20, and the Mw/Mn (value-B) for THF-soluble matter in the region of a molecular weight of not less than 1,500, is from 2 to 10; and fixing said toner image on the transfer medium by the use of a fixing means comprising a fixing roller and a pressure roller that are so provided as to be in mutual pressure contact, through which said transfer medium comes out in the direction inclined toward the pressure roller from the lien perpendicular to a line connecting the center of the fixing roller and the center of the pressure roller; and the surface of said fixing roller being made of a material comprising a fluorine-containing material.

26. The method according to claim 25, wherein said toner comprises toner particles formed by suspension polymerization.

27. The method according to claim 25, wherein said toner comprises toner particles formed by suspension polmerization of polymerizable monomer composition containing at least i) 100 parts by weight of a polymerizable monomer, ii) from 10 parts by weight to 50 parts by weight of paraffin wax having a weight average molecular weight of from 500 to 1,500 and a melting point of from 65° C. to 80° C., iii) a coloring agent, iv) a polar material and v) a polymerization initiator.

28. The method according to claim 27, wherein said polymerizable monomer comprises a styrene monomer.

29. The method according to claim 27, wherein said polymerizable monomer comprises a styrene monomer and an acrylate monomer.

30. The method according to claim 27, wherein said polymerizable monomer comprises a styrene monomer and a methacrylate monomer.

31. The method according to claim 25, wherein said fixing roller comprises a mandrel having thereon an elastic layer, and a fluorine resin-coated layer formed on said elastic layer.

32. The method according to claim 25, wherein said pressure roller has a harder surface layer than the fixing roller and has a hardness of not less than 40°.

33. The method according to claim 25, wherein said pressure roller has a harder surface layer than the fixing roller and has a hardness of not less than 50°.

34. The method according to claim 25, wherein said fixing roller has a softer surface layer than the pressure roller and has a hardness of from 30° to 70°.

35. The method according to claim 25, wherein said fixing roller has a softer surface layer than the pressure roller and has a hardness of from 35° to 60°.

36. The method according to claim 25, wherein said toner comprises a chromatic color toner.

37. The method according to claim 25, wherein said toner comprises a yellow toner, a magenta toner and a cyan toner.

38. The method according to claim 25, wherein said fixing roller and pressure roller are each provided with a heater inside of the mandrel.

39. The method according to claim 25, wherein said fixing roller has a diameter of from 30 mm to 90 mm, has an elastic layer with a thickness of from 0.5 mm to 5 mm on its mandrel, and has a fluorine resin layer with a thickness of from 5 μm to 100 μm on the elastic layer.

40. The method according to claim 25, wherein said fixing roller becomes concave at its nip area with the pressure roller.

41. The method according to claim 25, wherein said fixing roller is substantially uncoated with silicone oil.

42. The method according to claim 25, wherein the THF-soluble matter in said toner has a weight average molecular weight (Mw) of from 15,000 to 200,000, a number average molecular weight (Mn) of from 2,000 to 30,000 and a Mw/Mn (value-A) of from 5 to 15.

43. The method according to claim 25, wherein the Mw/Mn (value-B) for the fraction of THF-soluble matter having a molecular weight of not less than 1,500 in a chromatogram obtained by the gel permeation chromatography in said toner is from 2.5 to 8 and less than Mw/Mn (value-A) by at least 2.

44. The method according to claim 25, wherein said toner contains a styrene copolymer as a binder resin and a paraffin wax with a melting point of from 65° C. to 80° C. and said fixing roller has a fluorine resin-coated layer.

45. The method according to claim 44, wherein said fixing roller has a PFA resin-coated surface layer.

46. The method according to claim 44, wherein said fixing roller has a PTFE resin-coated surface layer.

47. The method according to claim 25, wherein said toner has a weight average particle diameter of 2 to 10 μm.

48. The method according to claim 25, wherein said toner has a weight average particle diameter of 2 to 8.5 μm.

49. The method according to claim 25, wherein said toner image is formed with a negatively chargeable toner.

50. The method according to claim 25, wherein the pressure applied between the fixing roller and the pressure roller is not less than 2 $kg/cm^2$.

* * * * *

UNITED STATES PATENT AND TRADEMARK OFFICE

CERTIFICATE OF CORRECTION

PATENT NO. : 5,391,450

DATED : February 21, 1995

INVENTOR(S) : TAKAYUKI NAGATSUKA, ET AL.

It is certified that error appears in the above-indentified patent and that said Letters Patent is hereby corrected as shown below: Title page:

Item [56]:
line FPD, "1219764 9/1989 Japan." and "1219769 9/1989 Japan." should read --1-219764 9/1989 Japan.-- and --1-219769 9/1989 Japan.--.

Column 4,
line 17, "containing" should read --contains--, and "resin" should read --resin,--;
line 22, "wherever" should read --wherein--; and
line 23, "resin," should read --resin. Said--.

Column 5,
line 10, "of" should read --on--.

Column 8,
line 16, "10" should read --10 mg.--.

Column 9,
line 20, "control of" should read --control--;
line 56, "poly-" should read --copoly- --; and
line 63, "azobisisobutyrionitrile" should read --azobisisobutyronitrile--.

Column 11,
line 29, "Br nsted" should read --Brønsted--.

UNITED STATES PATENT AND TRADEMARK OFFICE

CERTIFICATE OF CORRECTION

PATENT NO. : 5,391,450

DATED : February 21, 1995

INVENTOR(S) : TAKAYUKI NAGATSUKA, ET AL.

It is certified that error appears in the above-indentified patent and that said Letters Patent is hereby corrected as shown below:

Column 12,
line 67, "$3Na_{2S04}$" should read --$3Na_2SO_4$--.

Column 13,
line 28, "attribute" should read --attributed--;
line 49, "revolution" should read --revolutions--; and
line 58, "made" should read --made from--.

Column 15,
line 13, "the the" should read --the--;
line 14, "progress" should read --the progress--; and
line 22, "polystyrene" shold read --polystyrenes--.

Column 16,
line 19, "silica" should read --silica)--; and
line 60, "metal," should read --metal--.

Column 17,
line 21, "magnetic magnetic" should read --magnetic--.

UNITED STATES PATENT AND TRADEMARK OFFICE

CERTIFICATE OF CORRECTION

PATENT NO. : 5,391,450

DATED : February 21, 1995

INVENTOR(S) : TAKAYUKI NAGATSUKA, ET AL.

It is certified that error appears in the above-indentified patent and that said Letters Patent is hereby corrected as shown below:

Column 18,
line 28, "preparation" should read --in preparation--; and
line 35, "next" should read --next color--.

Column 20,
line 34, "The a" should read --The--; and
line 35, "was roller"should read --was a roller--.

Column 25,
line 38, insert --Comparative Example 1--.

Column 29,
line 54, "D: ≥50%" should read --D: <50%--; and
line 57, "comprising;" should read --comprising:--.

Column 30,
line 60, "then" should read --than--.

Column 31,
line 39, "particles" should read --particle--; and
line 42, "particles" should read --particle--.

Column 32,
line 1, "lien" should read --line--; and
line 11, "polmerization" should read --polymerization--.

Signed and Sealed this

Thirtieth Day of May, 1995

Bruce Lehman

*Attest:*

BRUCE LEHMAN

*Attesting Officer*

*Commissioner of Patents and Trademarks*